US010814621B2

(12) United States Patent
Mimoto

(10) Patent No.: US 10,814,621 B2
(45) Date of Patent: Oct. 27, 2020

(54) LIQUID EJECTING APPARATUS AND LIQUID EJECTION CONTROLLING METHOD

(71) Applicant: Brother Kogyo Kabushiki Kaisha, Nagoya-shi, Aichi-ken (JP)

(72) Inventor: Masao Mimoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/524,605

(22) Filed: Jul. 29, 2019

(65) Prior Publication Data

US 2020/0039214 A1 Feb. 6, 2020

(30) Foreign Application Priority Data

Jul. 31, 2018 (JP) ..... 2018-144094

(51) Int. Cl.
*B41J 2/045* (2006.01)
*B41J 29/377* (2006.01)

(52) U.S. Cl.
CPC ..... *B41J 2/04563* (2013.01); *B41J 29/377* (2013.01)

(58) Field of Classification Search
CPC .... B41J 2/04563; B41J 2/2054; B41J 2/2056; B41J 2/362; B41J 2/5056; B41J 29/393; B41J 2029/3937
See application file for complete search history.

(56) References Cited

U.S. PATENT DOCUMENTS

| | | | | |
|---|---|---|---|---|
| 5,353,052 | A * | 10/1994 | Suzuki | B41J 2/16588 347/19 |
| 5,596,353 | A | 1/1997 | Takada et al. | |
| 5,736,996 | A | 4/1998 | Takada et al. | |
| 6,832,825 | B1 * | 12/2004 | Nishikori | B41J 2/2128 347/19 |
| 10,166,771 | B2 | 1/2019 | Kasai et al. | |
| 2017/0232746 | A1 | 8/2017 | Nishida | |
| 2018/0015722 | A1 | 1/2018 | Kasai et al. | |

FOREIGN PATENT DOCUMENTS

| | | | |
|---|---|---|---|
| JP | H04-18359 | A | 1/1992 |
| JP | 2005-161660 | A | 6/2005 |
| JP | 2015-134468 | A | 7/2015 |
| JP | 2017-144726 | A | 8/2017 |
| JP | 2018-8484 | A | 1/2018 |

* cited by examiner

*Primary Examiner* — Jason S Uhlenhake
(74) *Attorney, Agent, or Firm* — Banner & Witcoff, Ltd.

(57) ABSTRACT

A liquid ejecting apparatus is configured to record a pattern group including a first pattern and a second pattern by driving a moving mechanism to perform a relative movement between a head and a recording medium and by driving the head to eject liquid towards the recording medium. The first pattern and the second pattern are recorded at different timings. Further, recording of the second pattern is performed when a temperature of the liquid in the head is temperature T2 which is different, by a target temperature difference or more, from temperature T1 which is a temperature of the liquid when the first pattern is recorded.

12 Claims, 16 Drawing Sheets

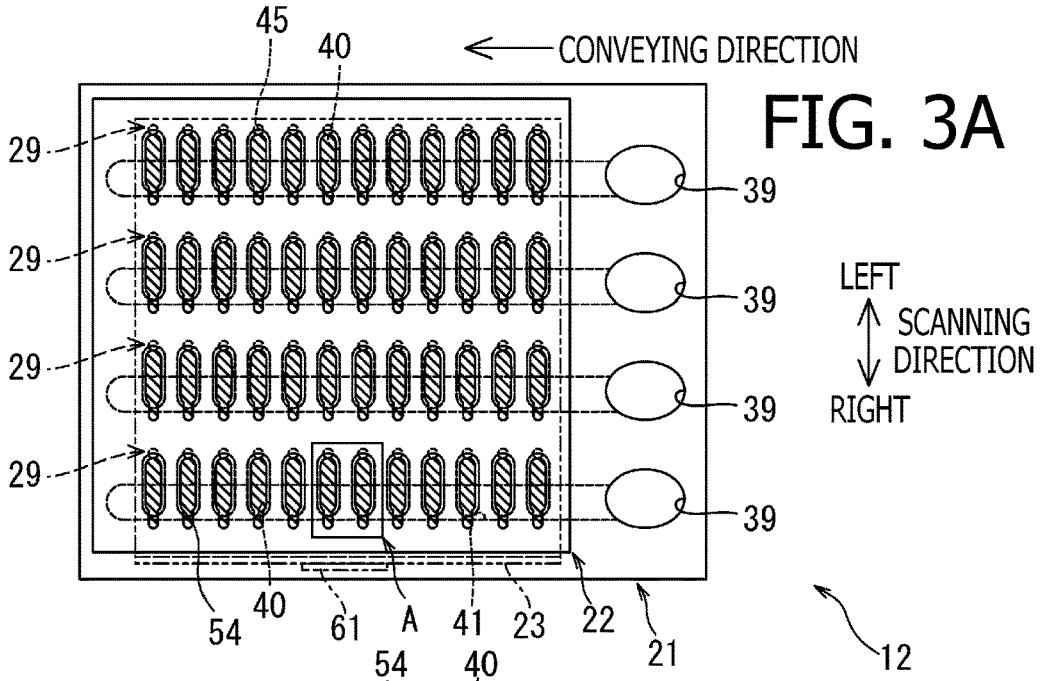
FIG. 3A
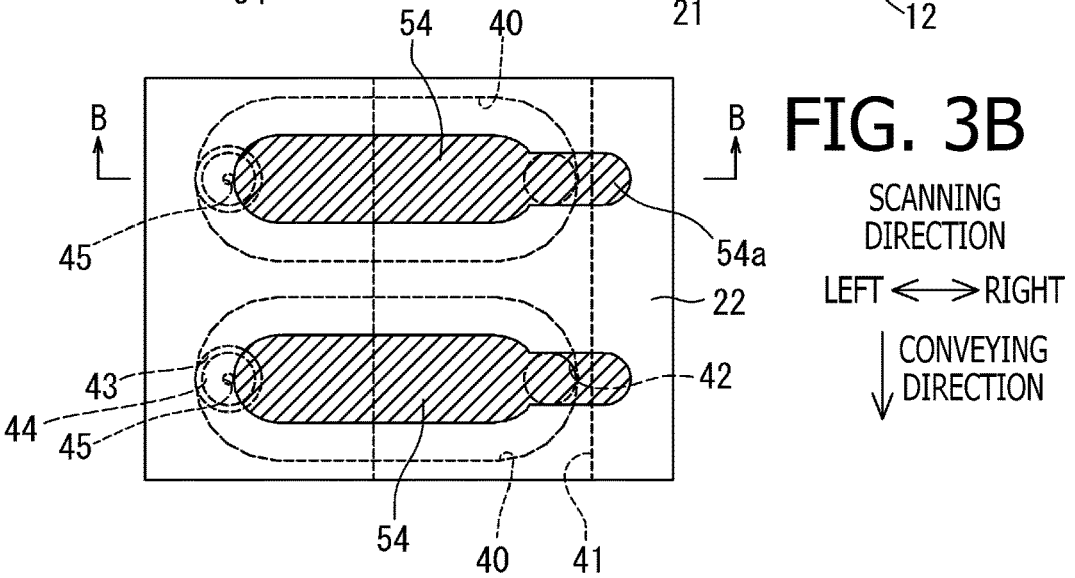
FIG. 3B
FIG. 3C
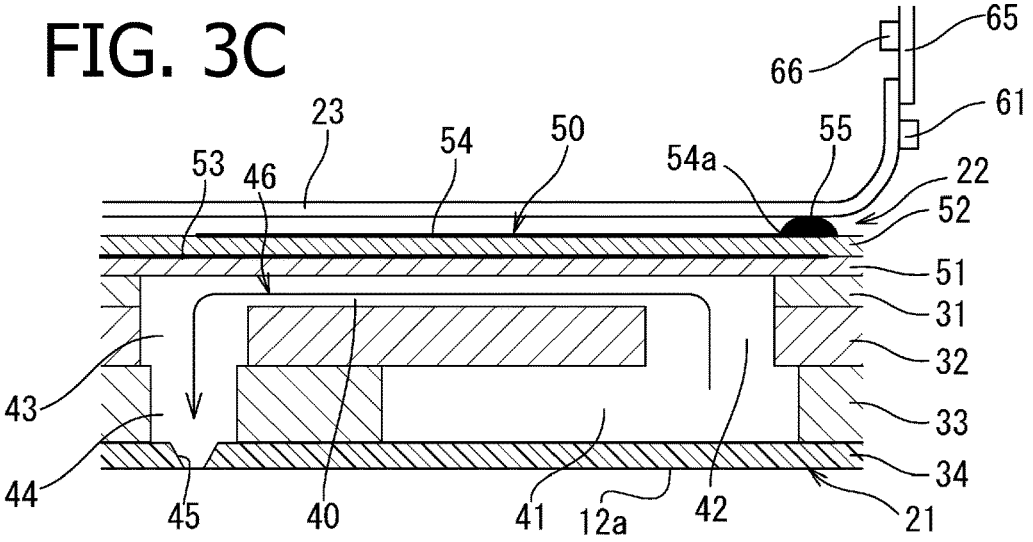

TARGET TEMPERATURE DIFFERENCE SETTING TABLE

| TEMPERATURE RANGE | TARGET TEMPERATURE DIFFERENCE |
|---|---|
| LOW TEMP. RANGE | D1 |
| MIDDLE TEMP. RANGE | D2 |
| HIGH TEMP. RANGE | D3 |

D1 < D2 < D3

CONCENTRATION ASSOCIATING DATA

| CROSS POINT DISTANCE | PARTICLE CONCENTRATION |
|---|---|
| Y1 | G1 |
| Y2 | G2 |
| Y3 | G3 |
| ⋮ | ⋮ |

Y1 < Y2 < Y3 G1 < G2 < G3

WHEN EJECTION SPEED IS REFERENCE SPEED

WHEN EJECTION SPEED IS FAST (WHEN VISCOSITY IS LOW)

WHEN EJECTION SPEED IS SLOW (WHEN VISCOSITY IS HIGH)

WHEN PARTICLE CONCENTRATION IS HIGH

WHEN PARTAICLE CONCENTRATION IS LOW

WHEN PARTICLE CONCENTRATION IS HIGH

WHEN PARTAICLE CONCENTRATION IS LOW

LIQUID EJECTING APPARATUS AND LIQUID EJECTION CONTROLLING METHOD

CROSS-REFERENCE TO RELATED APPLICATIONS

This application claims priority under 35 U.S.C. § 119 from Japanese Patent Application No. 2018-144094 filed on Jul. 31, 2018. The entire subject matter of the application is incorporated herein by reference.

BACKGROUND

Technical Field

The present disclosures relate to a liquid ejecting apparatus and a method of controlling liquid ejection of the liquid ejecting apparatus.

Related Art

There has been known an inkjet recording apparatus (i.e., an example of a liquid ejecting apparatus) which is provided with an ink-ejecting head configured to eject ink supplied from an ink tank (liquid tank). In such an inkjet recording apparatus, there could be a case where ink, which is composed such that particles are dispersed in a solvent (e.g., pigment ink), is used for printing. Such ink is advantageous such that clarity of an image printing with such ink (e.g., pigmented ink) is improved.

SUMMARY

When the ink composed such that the particles are dispersed in the solvent has been in a stationary state for a relatively long period, the particles precipitate. In a tank storing such ink, as the particles precipitate, particle concentration may be locally high at a bottom portion of the tank. In such a case, the particle concentration of the ink supplied from the tank to the head may not be constant but likely vary.

Viscosity of the ink, which effects ink ejection characteristic of the head, largely depends on the particle concentration of the ink. Therefore, in order to control ink ejection of the head appropriately, it is important to assume the particle concentration of the ink ejected from the ink with high accuracy.

According to aspects of the present disclosures, there is provided a liquid ejecting apparatus, which includes a head configured to eject liquid containing particles dispersed in solvent and supplied from a tank, a moving mechanism configured to move at least one of a recording medium and the head so that a relative movement of the head and the recording medium is performed, a temperature signal device configured to output a temperature signal corresponding to a temperature of the liquid in the head, a heat source and a controller. The controller is configured to cause the moving mechanism to perform the relative movement between the head and the recording medium and cause the head to eject the liquid towards the recording medium to record a concentration pattern group including a first pattern and a second pattern, the controller being configured to extrapolate the particle concentration of the liquid ejected from the head based on the concentration pattern group as recorded on the recording medium. When the concentration pattern group is recorded, the controller causes the head and the moving mechanism such that the first pattern and the second pattern are recorded at different timings and recording of the second pattern is started after execution of a temperature raising operation, the temperature raising operation being an operation to cause the heat source to generate heat and raise the temperature of the liquid in the head by applying the heat generated by the heat source until a temperature indicated by the temperature signal output by the temperature signal device has reached temperature T2 which is higher, by a target temperature difference, than temperature T1 which is a temperature of the liquid when the first pattern is recorded.

According to aspects of the present disclosures, there is provided a liquid ejecting apparatus, which includes a head configured to eject liquid containing particles dispersed in solvent and supplied from a tank, a moving mechanism configured to move at least one of a recording medium and the head so that a relative movement of the head and the recording medium is performed, a temperature signal device configured to output a temperature signal corresponding to a temperature of the liquid in the head, a cooling device and a controller. The controller is configured to cause the moving mechanism to perform the relative movement between the head and the recording medium and cause the head to eject the liquid towards the recording medium to record a concentration pattern group including a first pattern and a second pattern, the controller being configured to extrapolate the particle concentration of the liquid ejected from the head based on the concentration pattern group as recorded on the recording medium. When the concentration pattern group is recorded the controller causes the head and the moving mechanism such that the first pattern and the second pattern are recorded at different timings and recording of the second pattern is started after execution of a temperature lowering operation, the temperature lowering operation being an operation to cause the cooling device to lower the temperature of the liquid in the head by until a temperature indicated by the temperature signal output by the temperature signal device has reached temperature T2 which is lower, by a target temperature difference, than temperature T1 which is a temperature of the liquid when the first pattern is recorded.

According to aspects of the present disclosures, there is provided a liquid ejecting controlling method for a liquid ejecting apparatus having a head configured to eject liquid containing particles dispersed in solvent and supplied from a tank, a moving mechanism configured to move at least one of a recording medium and the head so that a relative movement of the head and the recording medium is performed. The method includes recording a pattern group including a first pattern and a second pattern by driving the moving mechanism to perform the relative movement between the head and the recording medium and by driving the head to eject the liquid towards the recording medium, and receiving user input of input information based on recording results of the first pattern and the second pattern, ejection of the liquid from the head being controlled based on the input information as received. Recording of the pattern group is performed such that the first pattern and the second pattern are recorded at different timings and recording of the second pattern is performed when a temperature of the liquid in the head is temperature T2 which is different, by a target temperature difference or more, from temperature T1 which is a temperature of the liquid when the first pattern is recorded.

BRIEF DESCRIPTION OF THE ACCOMPANYING DRAWINGS

FIG. 1 is a perspective view of an inkjet printer according to a first embodiment of aspects of the present disclosures.

FIG. 2 schematically shows a plan view of a recording section of the inkjet printer shown in FIG. 1.

FIG. 3A is a plan view of a head of the inkjet printer shown in FIG. 1.

FIG. 3B is a partially enlarged view of the head shown in FIG. 3A.

FIG. 3C is a cross-sectional view of the head taken along lien B-B in FIG. 3B.

Figures 5A, 5B, 5C:
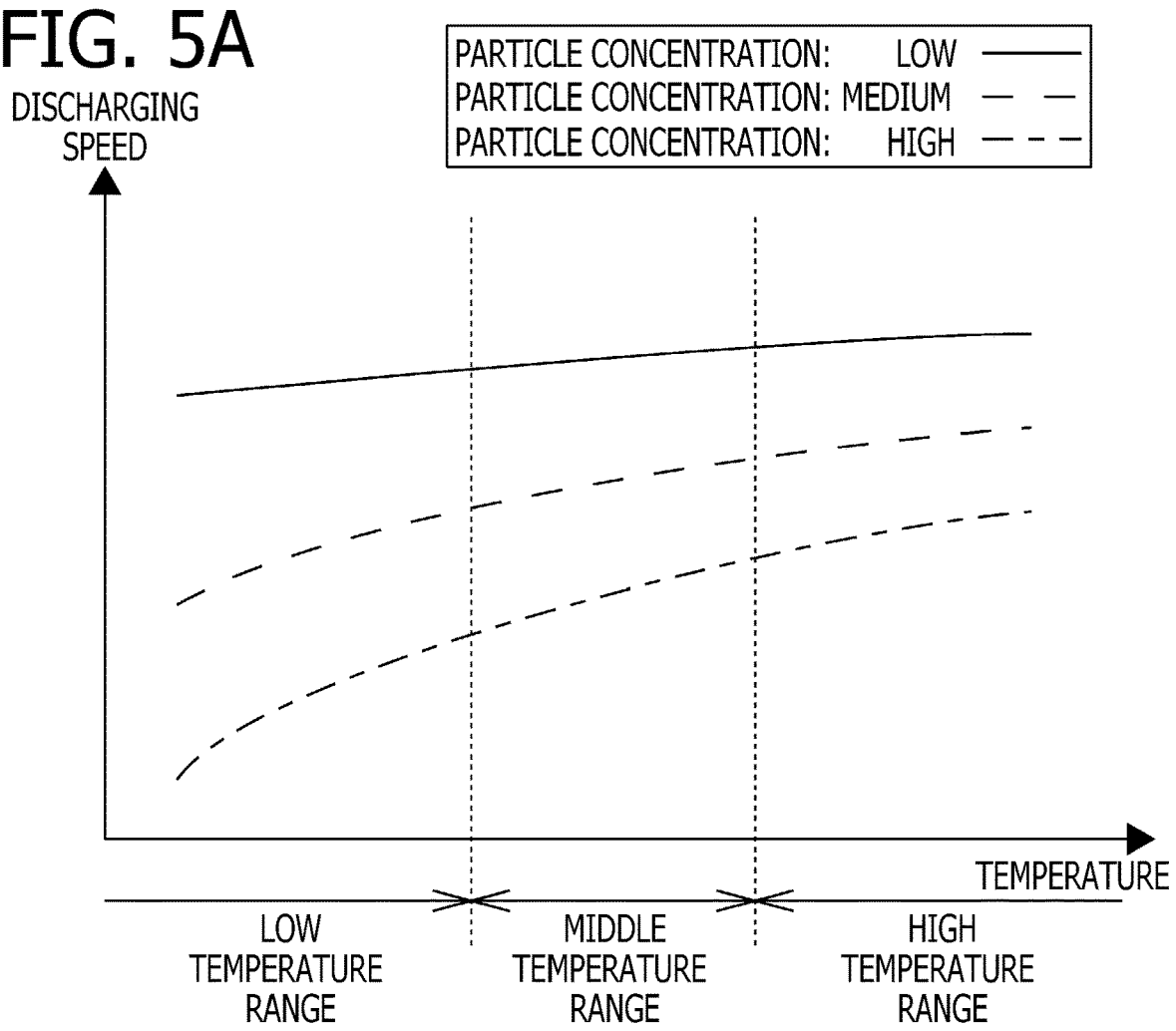
FIG. 5A is a graph showing a relationship between a temperature and an ejection speed of ink for different particle concentrations.

FIG. 5B schematically shows a target temperature difference setting table.

FIG. 5C schematically shows a configuration of temperature associating data.

Figure 6A:
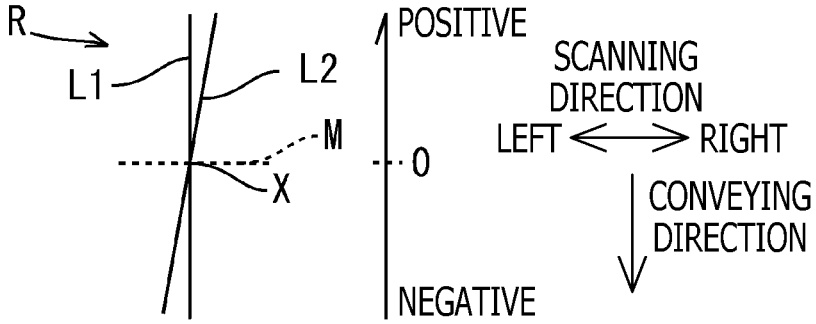
Figure 6B:
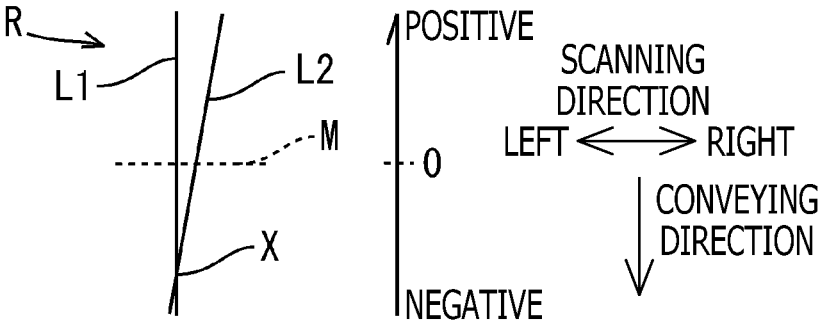
Figure 6C:
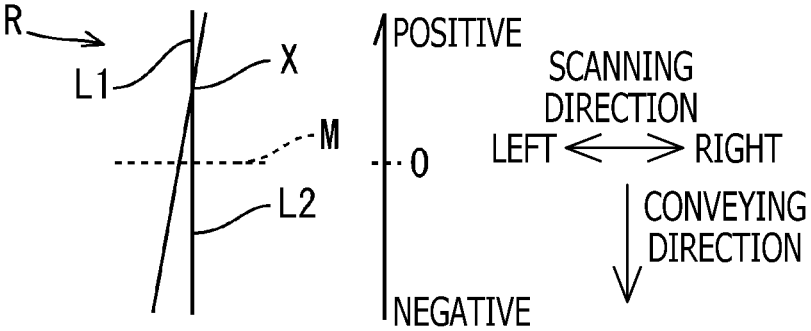

FIGS. 6A-6C show patterns configuring a concentration pattern group.

Figure 6D:
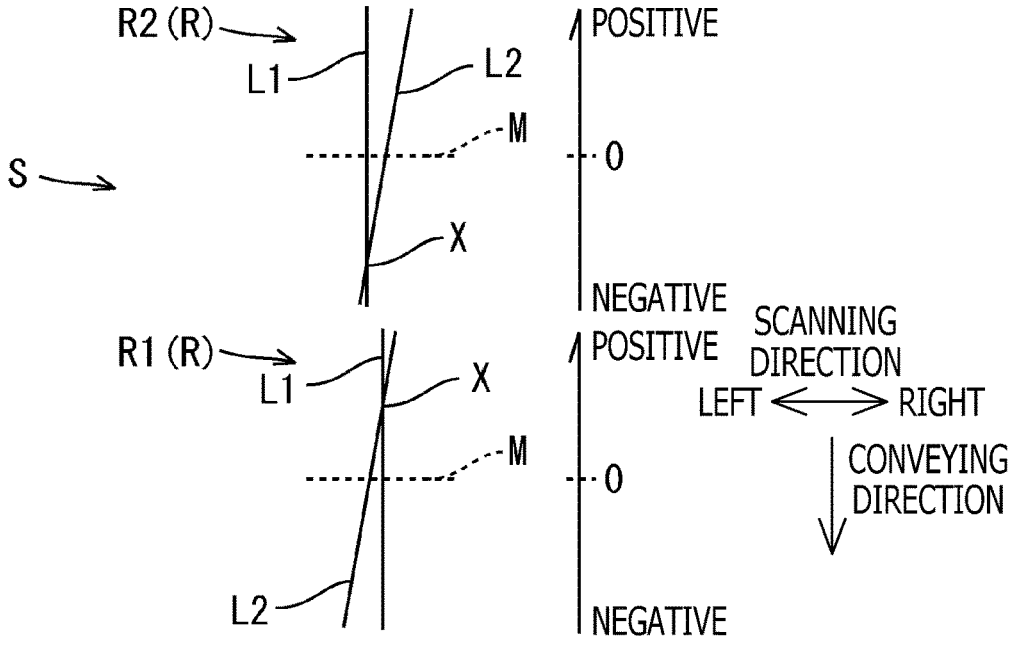
Figure 6E:
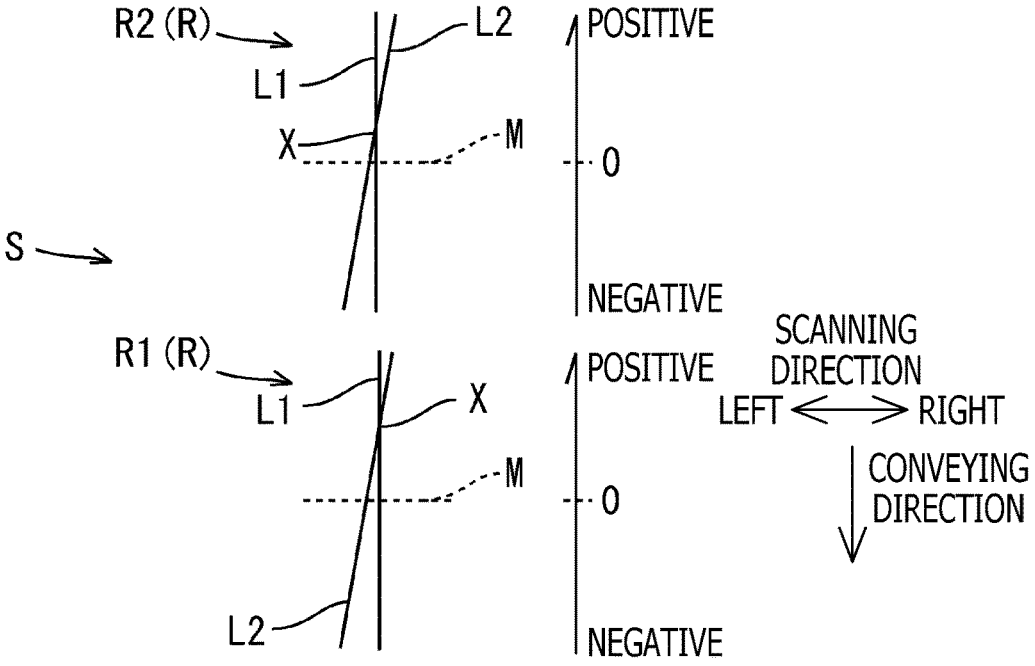

FIGS. 6D and 6E show patterns illustrating the concentration extrapolating patter group.

Figure 7A:
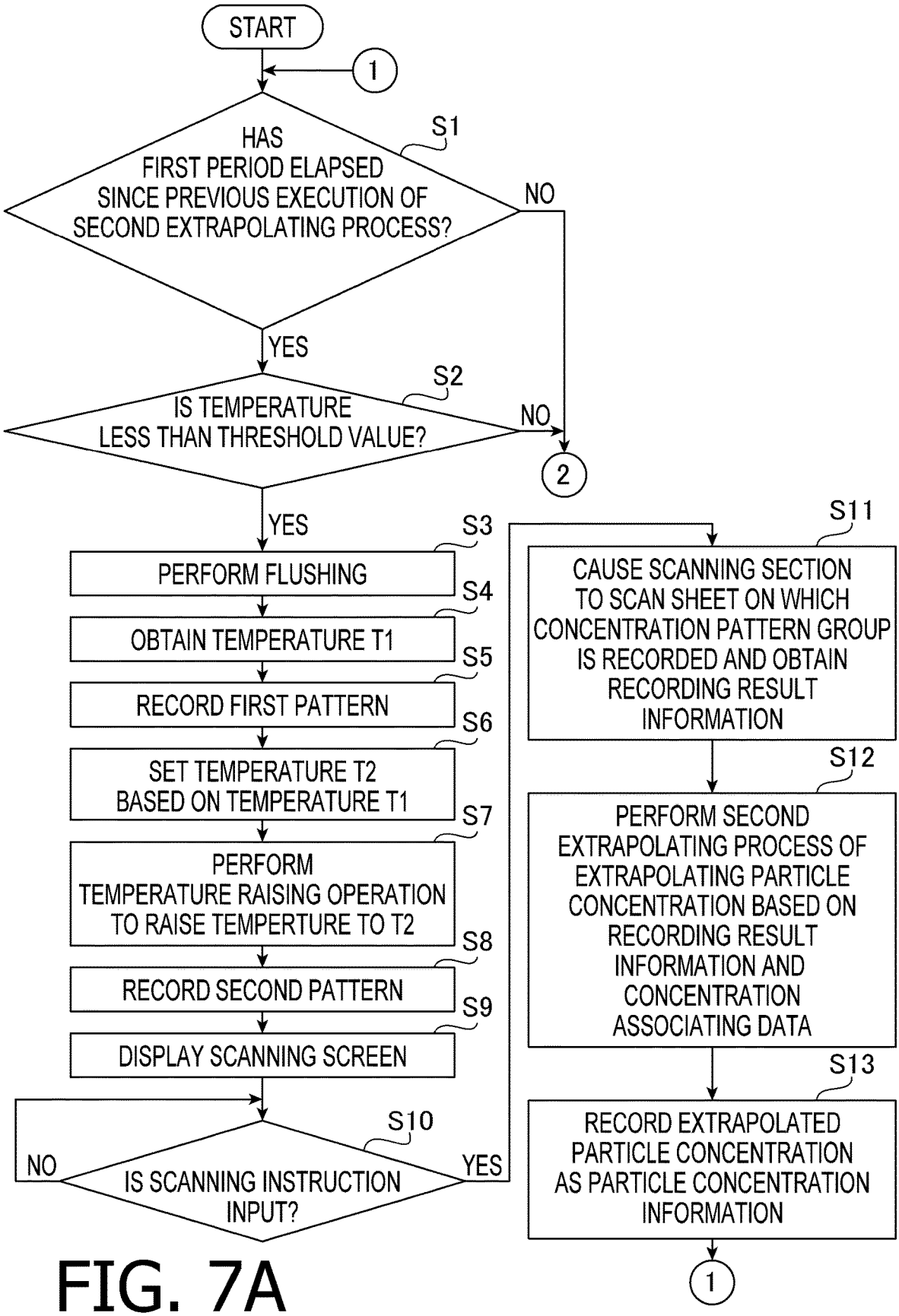
Figure 7B:
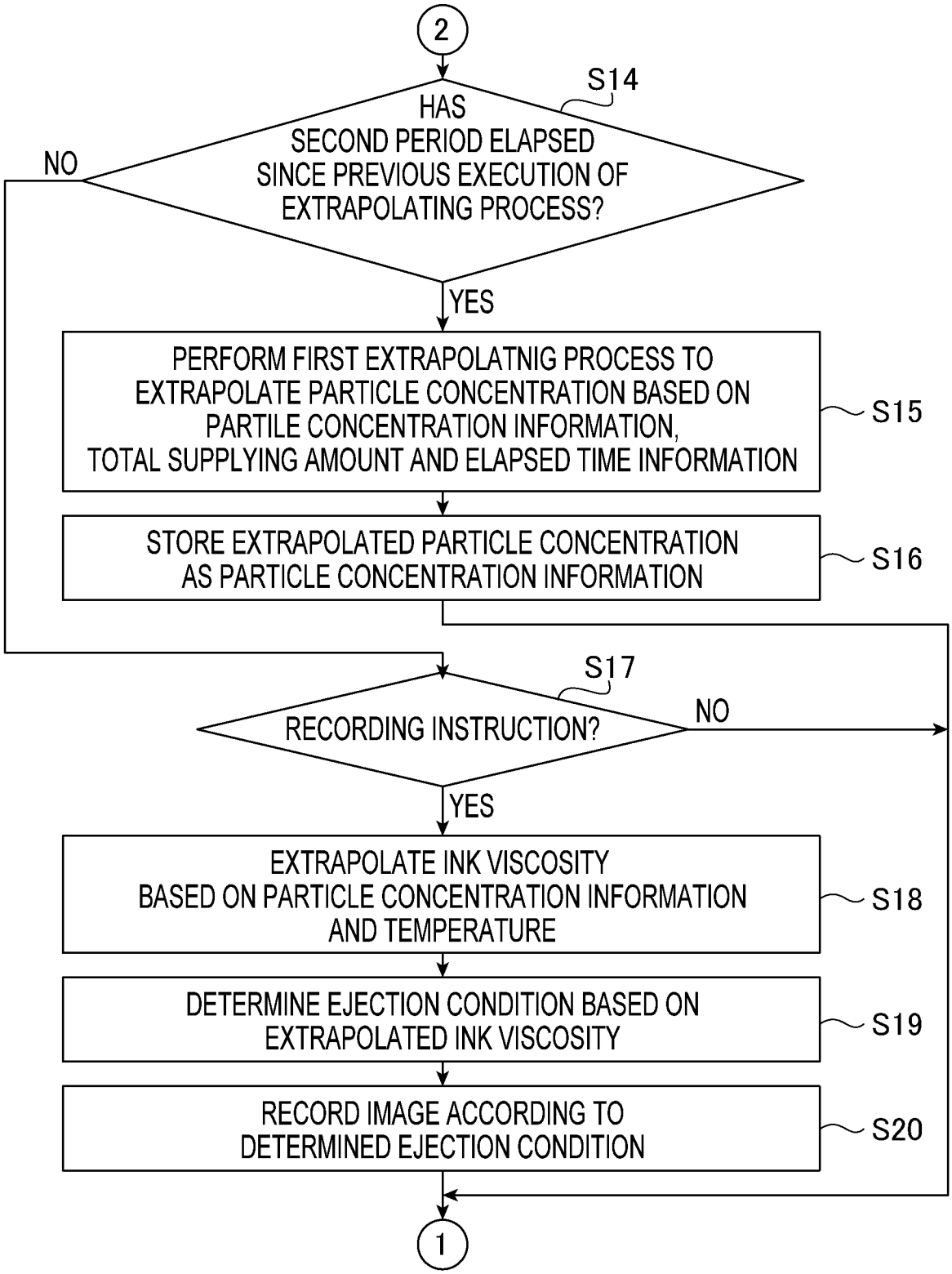

FIGS. 7A and 7B show a flowchart illustrating a main process of the inkjet printer according to aspects of the present disclosures.

Figure 8:
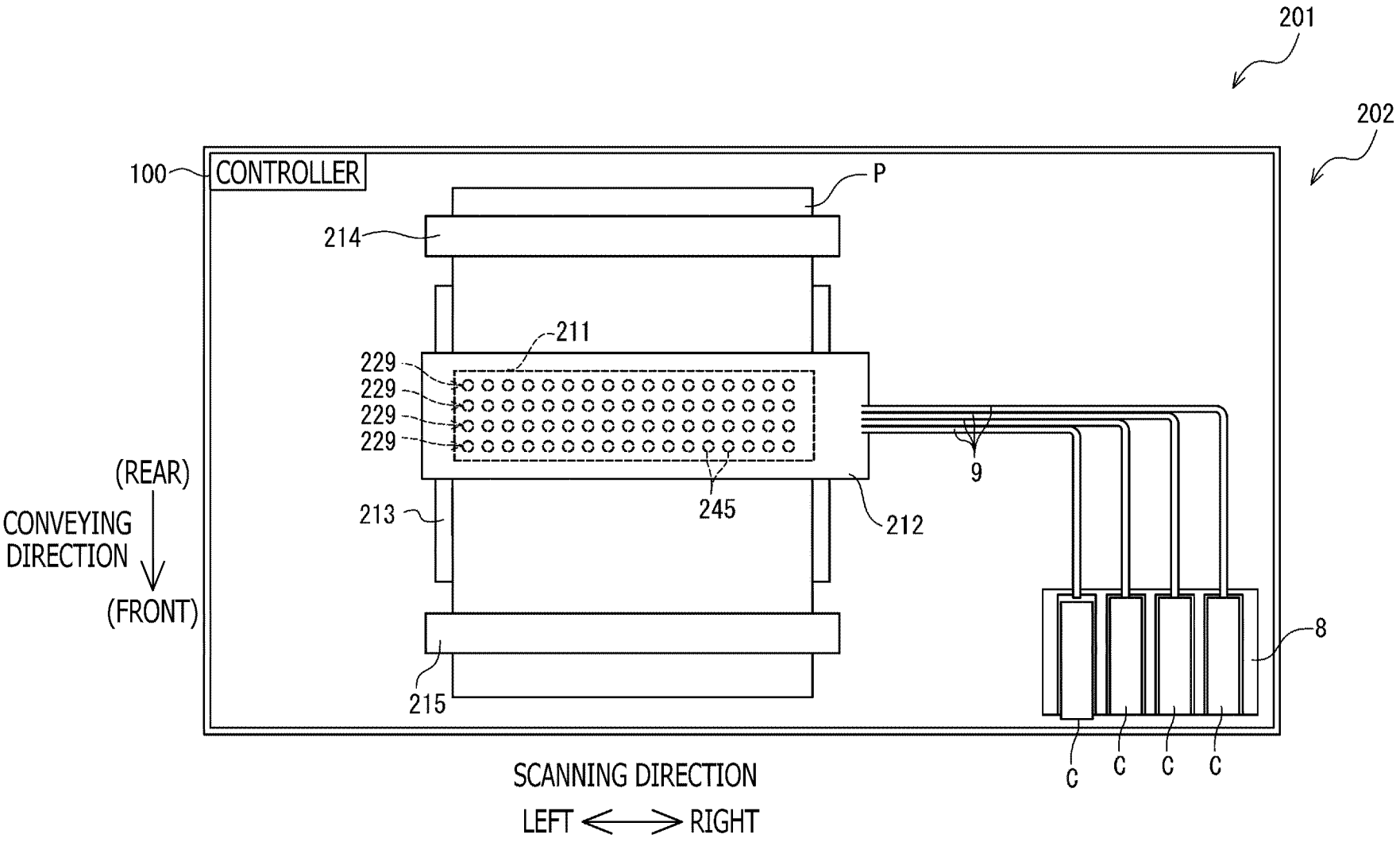

FIG. 8 schematically shows a plan view of a recording section according to a second embodiment of the present disclosures.

Figure 9A:
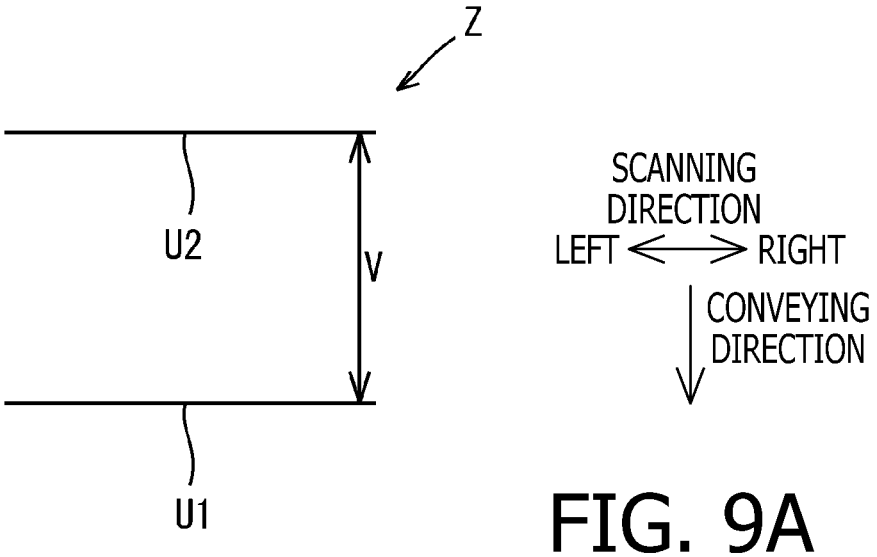
Figure 9B:
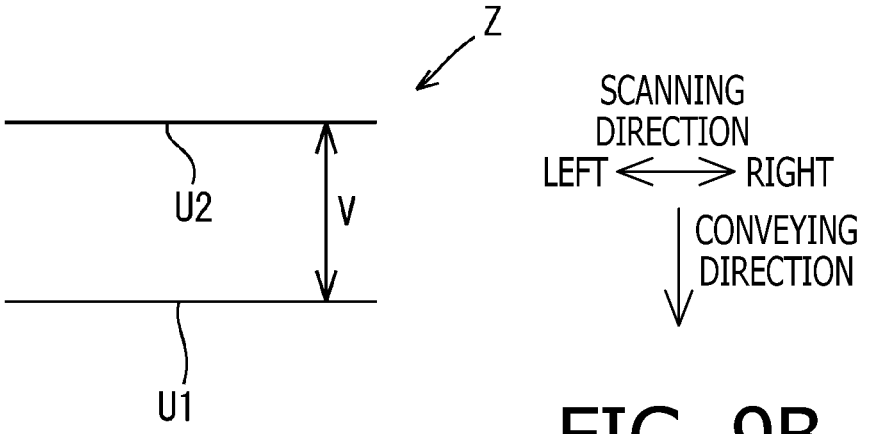

FIGS. 9A and 9B illustrate concentration extrapolating patterns according to the second embodiment.

Figure 10A:
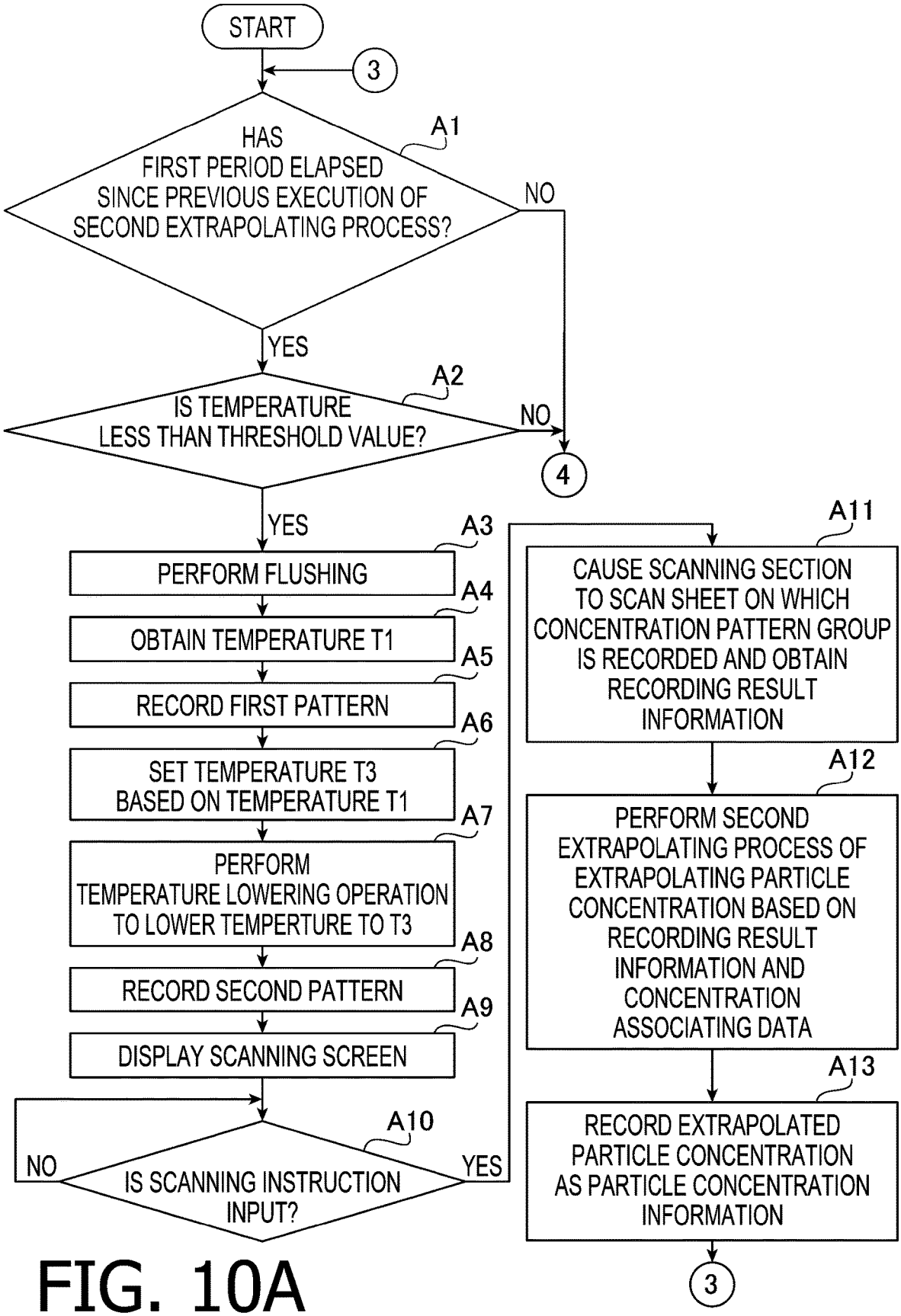
Figure 10B:
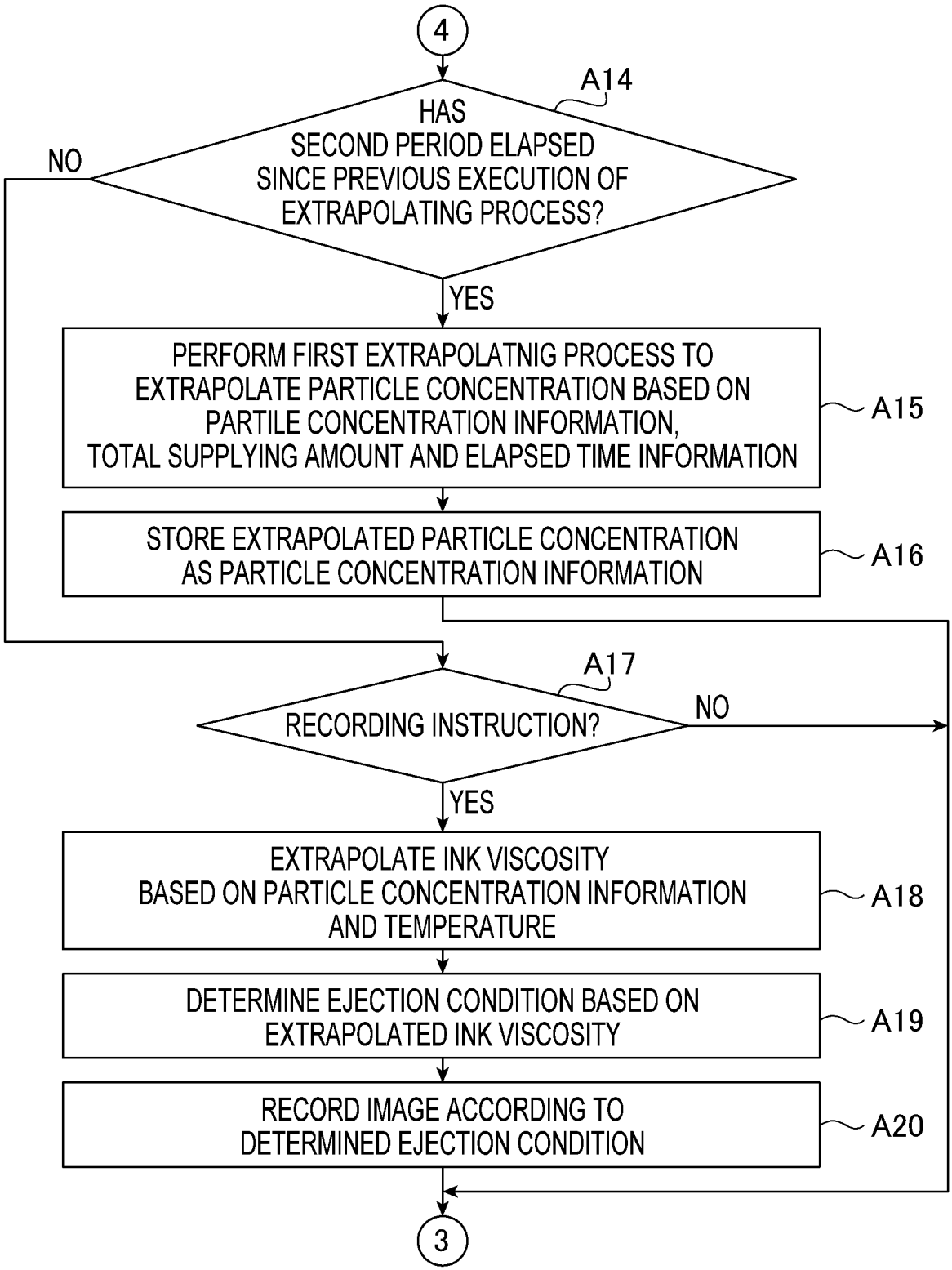

FIGS. 10A and 10B show a flowchart illustrating a main process of an inkjet printer according to a third embodiment of the present disclosures.

Figure 11:
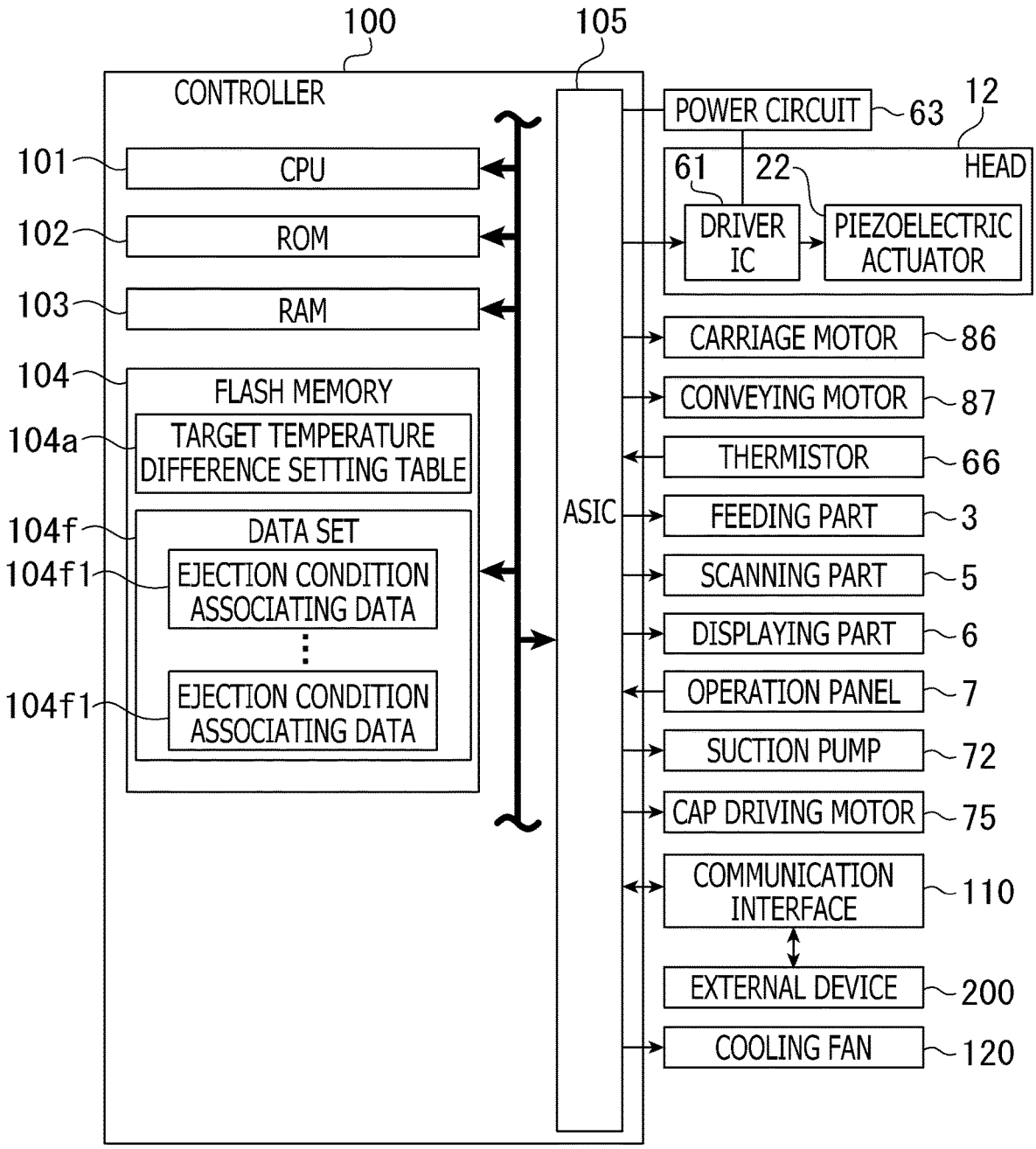

FIG. 11 is a block diagram showing an electrical configuration of an inkjet printer according to a fourth embodiment of the present disclosures.

Figure 12:
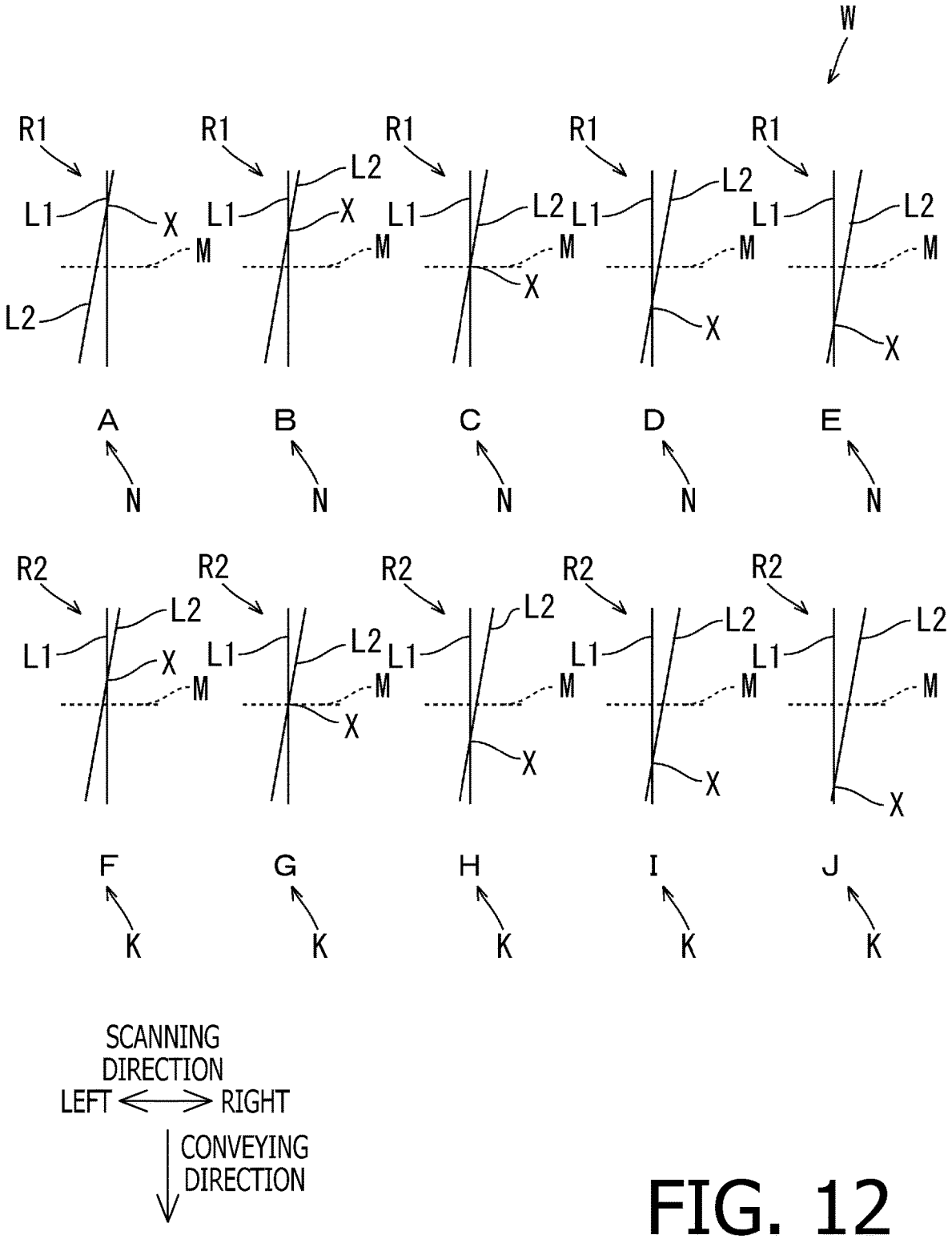

FIG. 12 illustrates a concentration extrapolating patterns according to the fourth embodiment.

Figure 13:
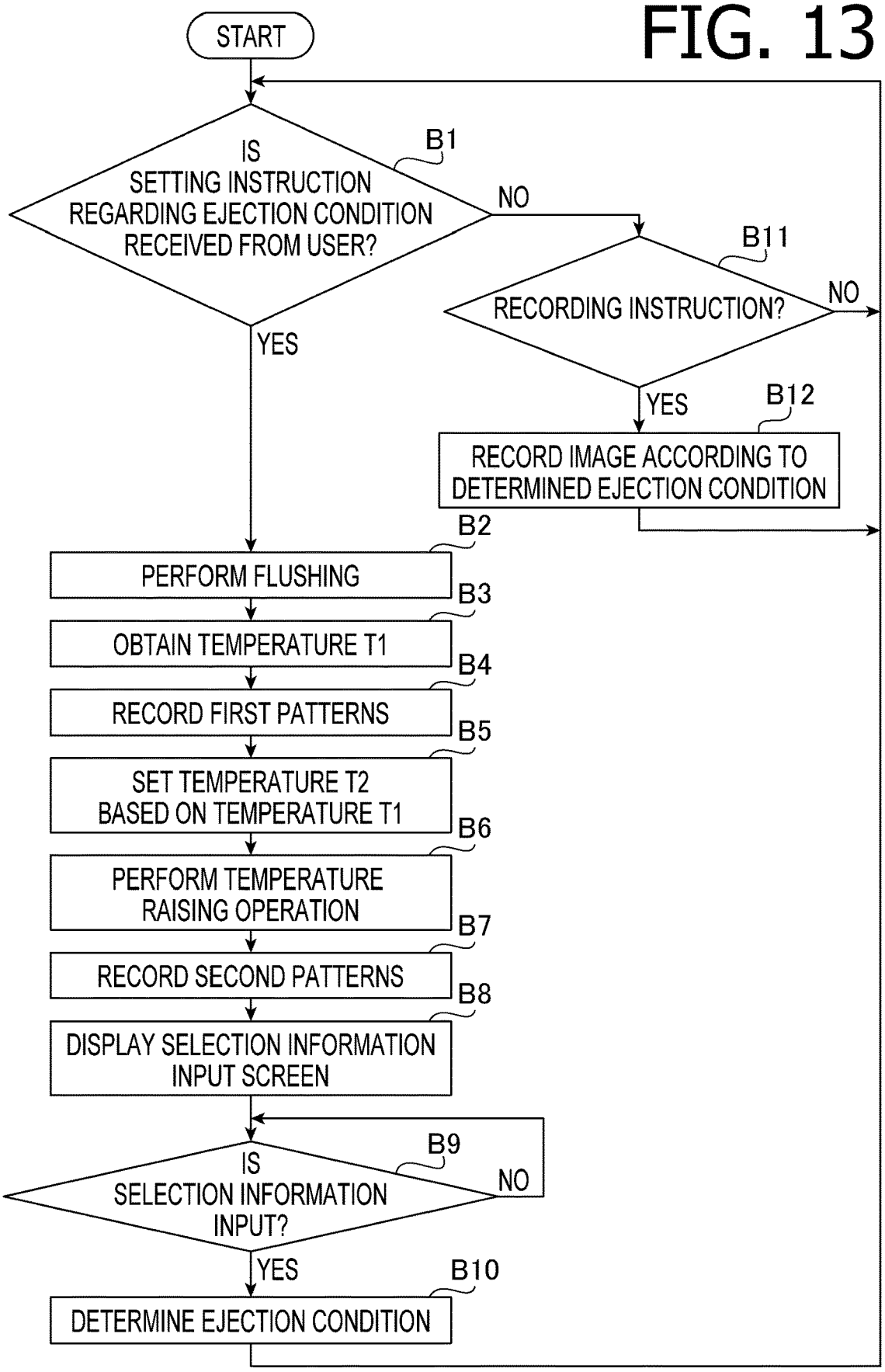

FIG. 13 is a flowchart illustrating a main process of the inkjet printer according to the fourth embodiment of the present disclosures.

DETAILED DESCRIPTION OF THE EMBODIMENTS

First Embodiment

Figure 1:
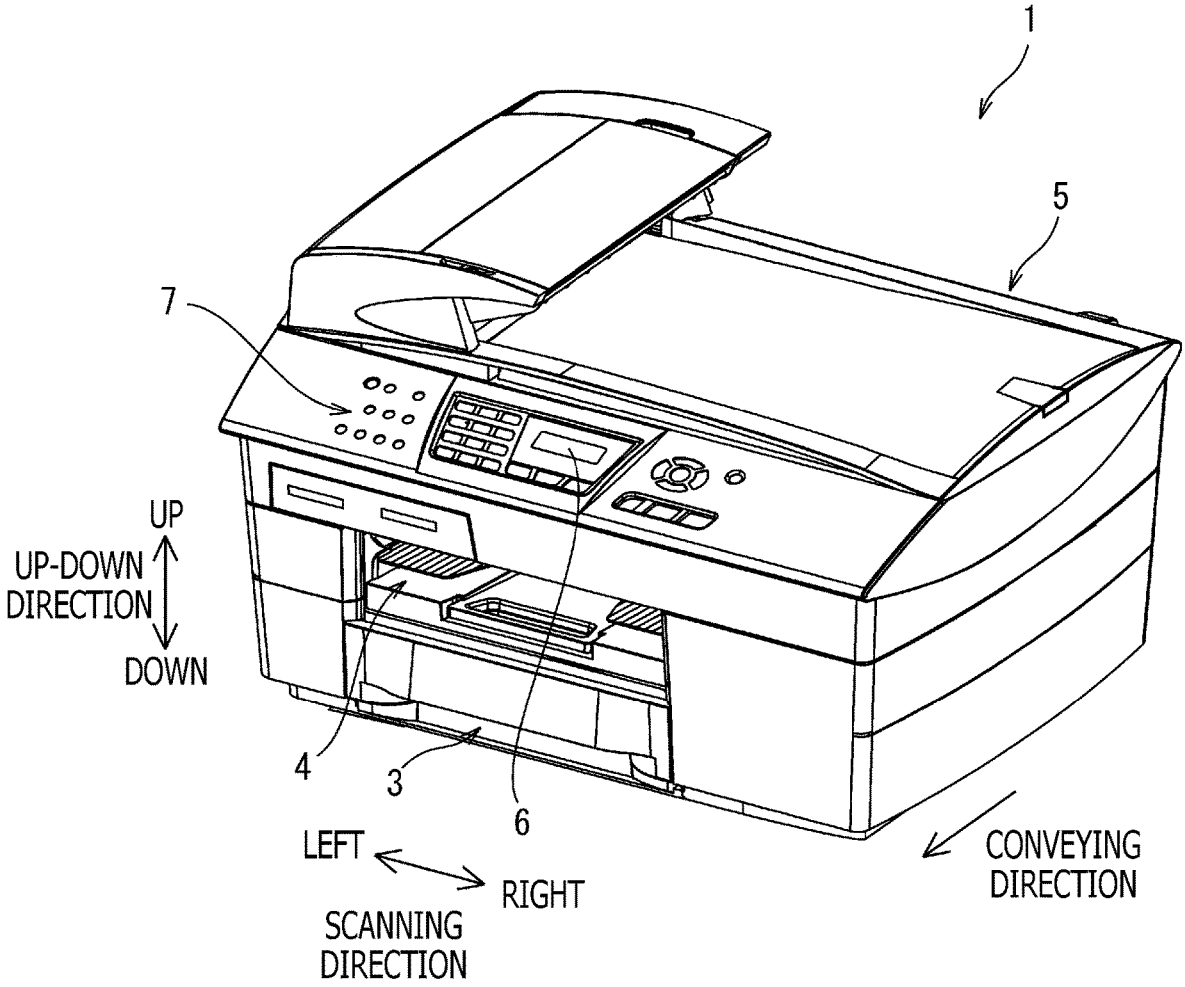

Hereinafter, an MFP 1 (the MFP 1 being an example of a liquid ejecting apparatus) according to a first embodiment will be described. The MFP 1 is configured to perform recording images on printing sheets P (the printing sheet P being an example of a recording medium), scanning of images on originals and the like. As shown in FIG. 1, the MFP 1 has a recording section 2 (see FIG. 2), a sheet feeding section 3, a discharging section 4, a scanning section 5 (the scanning section being an example of an image detecting section), a displaying section 6 and an operation panel 7. Further, an operation of the MFP 1 is controlled by a controller 100 (see FIG. 4).

The recording section 2 is arranged inside a casing of the MFP 1 and is configured to print images on the printing sheets P. The recording section 2 will be described in detail below. The sheet feeding section 3 functions to feed the printing sheets P toward the recording section 2. The discharging section 4 is a section to which the printing sheets P on which images are printed by the recording section 2 are discharged and stacked. The scanning section 5 includes, for example, an image scanner and is configured to read images recorded on original sheets. It is noted that the scanning section 5 is capable of reading images printed on the printing sheets P. It is noted that, in the following description, scanning of particular images will occasionally be referred to as "detection." The displaying section 6 includes, for example, an LCD and is configured to display information which is necessary when the MFP 1 is in use. The operation panel 7 includes buttons arranged on the casing of the MFP 1. When the displaying section 6 is configures as a touch panel, icons displayed on the displaying section 6 also included in the operation panel 7. A user of the MFP 1 makes the MFP 1 perform desired operations by operating the operation panel 7 (i.e., by operating the buttons/icons of the operation panel 7).

Figure 2:
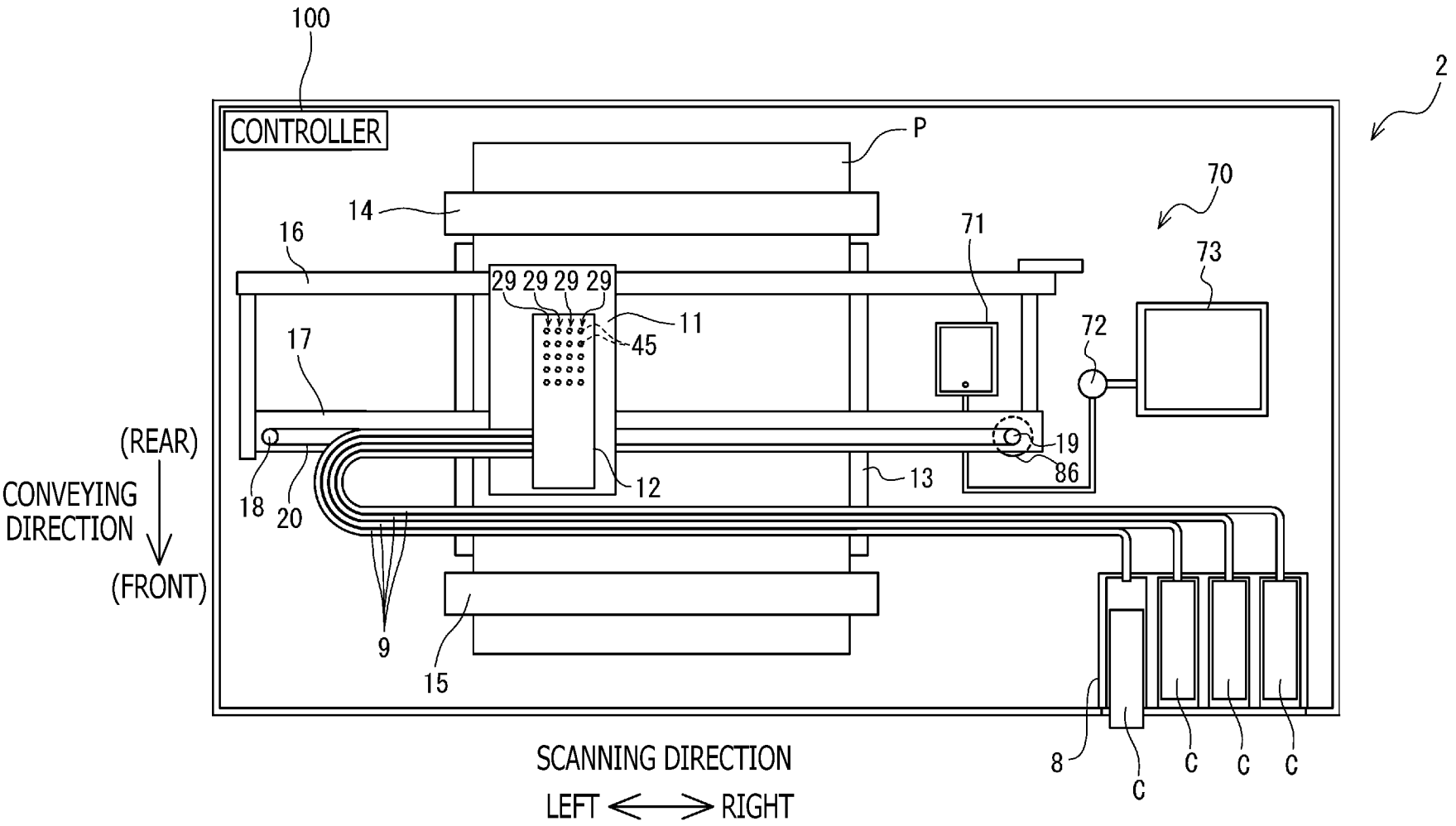
Figure 4:
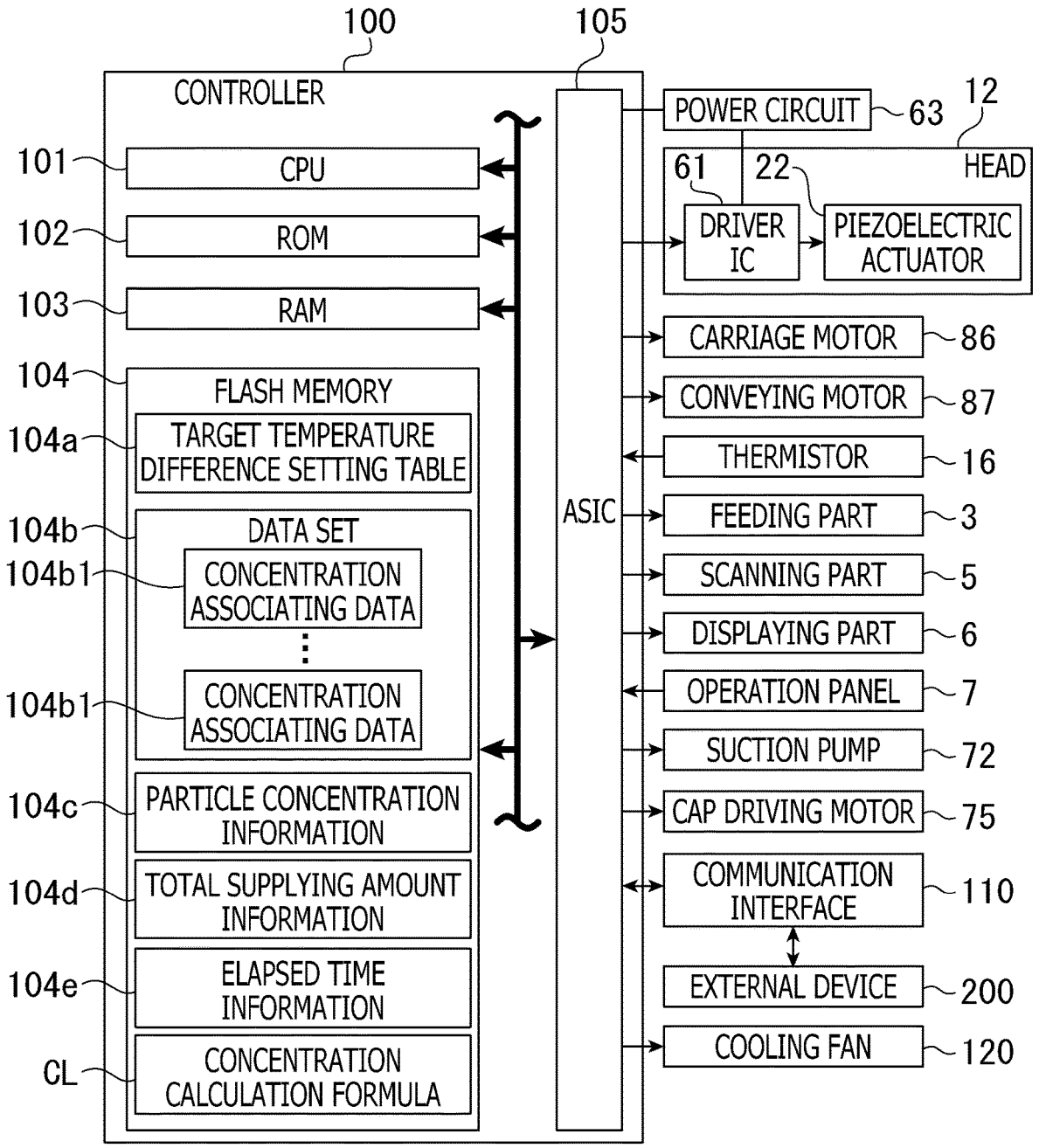
FIG. 4 is a block diagram, which shows an electrical configuration, of the inkjet printer according to aspects of the present disclosures.

As shown in FIG. 2, the recording section 2 is provided with a carriage 11 (the carriage 11 being an example of a moving mechanism), a head 12, a platen 13, a conveying roller pair 14 and a conveying roller pair 15, a purging device 70 and a cooling fan 120 (see FIG. 4).

As shown in FIG. 2, the carriage 11 is supported by two guide rails 16 and 17 which extend in a scanning direction. The two guide rails 16 and 17 are parallelly arranged in front-rear direction with a space therebetween. On an upper surface of the guide rail 17, pulleys 18 and 19 are provided at end portions thereof in the right-left direction (i.e., the scanning direction). An endless belt 20 made of rubber is wound around the pulleys 18 and 19. The carriage 11 is attached to a portion of the belt 20 between the pulleys 18 and 19. The right-side pulley 18 is connected with a carriage motor 86, while the left-side pulley 19 is configured to rotate freely. Accordingly, when the carriage motor 86 is rotated forwardly or reversely, the pulleys 18 rotates and the belt 20 moves in the scanning direction, thereby the carriage 11 reciprocally moves in the scanning direction (i.e., the right-left direction). The left-side pulley 19 is rotated by the movement of the belt 20.

The head 12 is mounted on the carriage 11. The head 12 is configured to eject ink droplets from a plurality of nozzles formed on a nozzle surface 12*a* (see FIG. 3C) which is a bottom surface of the head 12. The plurality of nozzles 45 are arranged a nozzle row 29 as being arranged in a conveying direction which is perpendicular to the scanning direction, and the head 12 includes four nozzle rows 29 which are arranged in the scanning direction. From the plurality of nozzles 45 constituting four nozzle rows 29, black, yellow, cyan and magenta pigmented inks are ejected, respectively, from the rightmost nozzle row 29 to the leftmost nozzle row 29 in this order. The pigmented ink is composed such that color particles are dispersed within a solvent. The head 12 will be described in detail below. As shown in FIG. 1, in the recording section 2, a cartridge attachment section 8 is defined and for ink cartridges C respectively storing four color inks are detachably attached to the cartridge attachment section 8. When the four ink cartridges C are attached to the cartridge attachment section 8, the head 12 and bottom portions of the four ink cartridges C are connected through ink tubes 9. Thus, from four ink cartridges C, the four color inks are supplied to the head 12 through the ink tubes 9, respectively.

A platen 13 is arranged below the head 12 and at a position where the platen 13 faces the head 12. The platen 13 is configured such that a width in the right-left direction is longer than the width in the right-left direction of the printing sheet P, thereby the platen 13 supporting the printing sheet P from below when images are printed on the printing sheet P.

The conveying roller pair 14 is arranged on an upstream side, in the conveying direction, with respect to the head 12, while the conveying roller pair 15 is arranged on a downstream side, in the conveying direction, with respect to the head 12. The conveying roller pairs 14 and 15 are connected to a conveying motor 87 (see FIG. 4) through gears. When the conveying motor 87 is driven to rotate, the conveying roller pars 14 and 15 respectively nip the printing sheet P, which is fed from the sheet feeding section 3, in an up-down direction, and convey the printing sheet P in the conveying direction.

The purging device 70 is for maintaining and restoring inkjet capacity of the head 12. The purging device 70 is arranged at a position, within a movable range of the carriage 11 in the scanning direction, outside (on a right-hand side in FIG. 2) an area in which the carriage 11 faces the printing sheet P. The purging device 70 includes a cap member 71, a suction pump 72 and a drainage tank 73. The cap member 71 is configured to be moved in an up-down direction by a cap driving motor 75 (see FIG. 4). Specifically, when the carriage 11 faces the cap member 71 in the up-down direction, by driving the cap driving motor 75, the cap member 71 is moved between a capping position where the cap member 71 closely contacts the head 12 to cover the nozzles 45 and an uncap position where the cap member 71 is spaced from the head 12 in the up-down direction.

The suction pump 72 is connected to the cap member 71. By depressurizing the inside of the cap member 71 with the suction pump 72 when the cap member 71 is located at the capping position, the ink is forced to be discharged from the plurality of nozzles 45 into the cap member 71. This ink discharging operation is generally known as a suction purging. By the suction purging, the air and/or dust mixed in the ink, and thickened ink can by discharged from the plurality of nozzles 45. The ink discharged from the nozzles 45 by the suction purging is sent to the drainage tank 73.

The cooling fan 12 (the cooling fan 12 being an example of a cooling device) is for cooling the head 12. The cooling fan 120 rotates under control of the controller 100 to fan the head 12, thereby the temperature of the head 12 being lowered. Further, as the temperature of the head 12 is lowered, the temperature of the ink is also lowered.

Next, the head 12 will be described in detail. As shown in FIGS. 3A-3C, the head 12 is provided with a flow channel unit 21, a piezoelectric actuator 22 and a COF (Chip On Film) 23.

The flow channel unit 21 is formed by laminated four plates 31-34. In the plate 31, a plurality of pressure chambers 40 are formed. Each pressure chamber 40 has, in plan view, an oval shape or a rounded-rectangular shape of which longitudinal direction extends in the scanning direction. The plurality of pressure chambers 40 are arranged in the conveying direction to form a row of pressure chambers 40, and there are four rows of pressure chambers 40, which are parallelly arranged in the scanning direction, on the plate 31.

On the plate 32, a plurality of through holes 42 and a plurality of through holes 43 are formed. The plurality of through holes 42 are provided to the plurality of pressure chambers 40, respectively. Each through hole 42 is arranged to overlap, in the up-down direction, a right end part, in the scanning direction, of the pressure chamber 40 (see FIG. 3B). The plurality of through holes 43 are provided to the plurality of pressure chamber 40, respectively. Each through hole 43 is arranged to overlap, in the up-down direction, a left end part, in the scanning direction, of the pressure chamber 40.

On the plate 33, four manifolds 41 and a plurality of through holes 44 are formed. The four manifolds 41 correspond to the above-described four rows of chamber rooms 40, respectively. That is, each manifold 41 extends in the conveying direction over the plurality of chamber rooms 40 of each row of chamber room 40. Further, each manifold 41 overlap, in the up-down direction, a right side part of the chamber rooms 40 (see FIG. 3A). Further, each manifold 41 is provided with an ink supplying port 39 at an end part, on the upstream side in the conveying direction (see FIG. 3A). the four ink supplying ports 39 of the four manifolds 41 are connected to the four ink cartridges C through the ink tubes 9, respectively (see FIGS. 2 and 3A). According to the above configuration, the ink is supplied, through the ink supplying ports 39, to the four manifolds 41, respectively. It is noted that the plurality of through holes 44 are provided to the plurality of chamber rooms 40, respectively. The plurality of through holes 44 are arranged to overlap, in the up-down direction, the plurality of through holes 43, respectively.

On the plate 34, a plurality of nozzles 45 are formed, and a lower surface of the plate 34 serves as the nozzle surface 12*a* of the head 12. The plurality of nozzle 45 are provided to the plurality of pressure chambers 40, respectively. Each nozzle 45 is arranged to overlap the through hole 44 in the up-down direction. Thus, on the plate 45, the four nozzle rows 29 are formed as mentioned above. According to the above-described configuration, a plurality of individual flow channels 46 are formed to the flow channel unit 21. Each individual flow channel 46 is defined by one nozzle 45, the pressure chamber 40 and the through holes 42-44 corresponding to the nozzle 45.

The piezoelectric actuator 22 has piezoelectric layers 51 and 52, a common electrode 53 and a plurality of individual electrodes 54. Each of the piezoelectric layers 51 and 52 is formed of piezoelectric material mainly composed of lead zirconate titanate which is a mixed crystal of lead titanate and lead zirconate. The piezoelectric layer 51 is arranged on the upper surface of the plate 31 so as to cover the plurality of pressure chambers 40. The piezoelectric layer 52 is arranged on an upper surface of the piezoelectric layer 51 and continuously extends over the plurality of pressure chambers 40. It is noted that a layer of an insulating material other than the piezoelectric material (e.g., a synthetic resin material) may be arranged instead of the piezoelectric layer 51.

The common electrode 53 continuously extends, between the piezoelectric layer 51 and the piezoelectric layer 52, over the plurality of pressure chambers 40. The common electrode 53 is connected to a power circuit 63 (see FIG. 4) through a COF 23 and an FPC 65 (described later) and is maintained to a ground potential.

The plurality of individual electrodes 54 are provided in the plurality of pressure chambers 40, respectively. Each individual electrode 54 is configured such that a longitudinal direction in the plan view is the scanning direction. The individual electrode 40 has, in the plan view, an oval (or a rounded rectangular) shape slightly smaller than the pressure chamber 40, and overlap a central part of the pressure chamber 50 in the up-down direction. Further, a right end part of the individual electrode 54 extends over a position at which the individual electrodes 54 does not overlap the pressure chamber 40 in the up-down direction. A tip end of the right end portion of the individual electrode 54 is formed as a connecting terminal 54*a*. On a surface of the connecting terminal 54*a*, a bump 55 is formed. A plurality of bump 55 respectively formed on the connecting terminal 54*a* of the plurality of individual electrodes 54 are connected with the COF 23.

In correspondence with the arrangement of the common electrode 53 and the plurality of individual electrodes 54 as described above, portions of the piezoelectric layer 52 sandwiched between the common electrode 53 and the respective individual electrode 54 are polarized in the up-down direction. A portion of the piezoelectric actuator 22 overlapping each pressure chamber 40 in the up-down direction serves as a piezoelectric element 50 (the piezoelectric element 50 being an example of a driving element) which applies pressure to the ink inside each pressure chamber 50.

The COF 23 is a flexible film-like wired member. The COF 23 extends rightward from a portion connected with the plurality of bumps 55 and is bent and extends upward. On a surface of a portion of the COF 23 extending in the up-down direction, a driver IC 61 (the driver IC 61 being an example of a "heat source" and a "driving circuit") is implemented. The driver IC 61 is connected to the power circuit 63 (see FIG. 4) through the COF 23 and an FPC 65 (described later). Electric power is supplied to the driver IC 61 from the power circuit 63. The driver IC 61 is for driving the piezoelectric actuator 22 (or the plurality of piezoelectric elements 50). Specifically, the driver IC 61 outputs a driving signal having a particular driving waveform to the plurality of individual electrodes 54 individually, thereby switching the potential of each individual electrode 54 between the ground potential and a driving potential (e.g., about 20V).

According to the illustrative embodiment, ink ejection amount types (types of volumes of ejected ink droplets) which can be output from each nozzle 45 within one recording cycle are four (i.e., a large drop, an intermediate drop, a small drop, no drop). Corresponding to the four ink ejection amount types, there are four types of driving signals to be applied to each individual electrode 54. The driver IC 61 outputs to each of the individual electrodes 54, one of the four types of driving signals at each of a plurality of recording cycles which are temporally continuous. It is noted that the one recording cycle is a time period necessary for the head 12 (i.e., the carriage 11) to move by a unit distance which corresponds to a resolution of the image to be recorded on the printing sheet P in the scanning direction.

The COF 23 is connected to the FPC 65 at an end part thereof opposite to the piezoelectric actuator 22. On the FPC 65, a thermistor 66 (the thermistor 66 being an example of a temperature signal device) is arranged. The thermistor 66 outputs a temperature signal corresponding to the temperature itself. It is noted that the driver IC 61 generates heat as energy is applied from the power circuit 63 when the piezoelectric actuator 22 is driven. The heat generated by the driver IC 61 is transferred to the head 12 and the thermistor 66 through the COF 23 and the FPC 65. Therefore, the temperature signal output by the thermistor 66 corresponds to the temperature of the ink inside the head 12 and the temperature of the driver IC 61. It is noted that the temperature signal output by the thermistor 66 may be a signal representing the temperature itself, or a value of a parameter corresponding to the temperature.

As shown in FIG. 4, the controller 100 includes a CPU 101, a ROM 102, a RAM 103, a flash memory 104 and an ASIC 105. The ROM 102 stores programs to be executed by the CPU 101 and various pieces of fixed data and the like. The RAM 103 temporarily stores data (e.g., image data) to be temporarily stored when various programs are executed. The flash memory 104 stores a target temperature difference setting table 104*a* (which will be described later). The ASIC 105 is connected with various sections and driving parts of the MFP 1 such as the head 12, the thermistor 66, the carriage motor 86, the conveying motor 87, the power circuit 63, the sheet feeding section 3, the scanning section 5, the displaying section 6, the operation panel 7, the suction pump 72, the communication interface 110 and the like.

The controller 100 executes the programs stored in the ROM 102 to perform various processes. For example, the controller 100 controls the head 12 and the carriage motor 86 to perform a recording process to record images on the printing sheets P. Further, the controller 100 controls the purging device 70 to perform suction purge and controls the piezoelectric actuator 22 of the head 12 to perform flushing, thereby performing a discharging process to discharge the ink from the nozzles 45.

It is noted that the control 100 may be configured such that only the CPU 101 performs the processes, only the ASIC 105 performs the processes, or the CPU 101 and the ASIC 105 cooperate to perform the processes. Further, the controller 100 may be configured such that one CPU 101 independently performs various processes, or a plurality of CPUs 101 perform the processes in a shared manner. Furthermore, the controller 100 may be configured such that only one ASIC 105 independently performs various processes, or a plurality of ASICs 105 perform various processes in a shared manner.

Hereinafter, the recording process will be described in detail. When the controller 100 receives a recording instruction form an external device 200 (e.g., a PC) through the communication interface 110, the controller 100 performs the recording process. That is, when receiving the recording instruction, the controller 100 alternately performs a recording operation to cause the head 12 to eject ink droplets with driving the carriage motor 86 to move the head 12, together with the carriage 11, reciprocally in the right-left direction and a conveying operation to drive the conveying motor 87 to make the two roller pairs 14 and 15 to convey the printing sheet P in the conveying direction, thereby recording desired images on the printing sheet P. That is, the printer implemented in the MFP 1 is a serial inkjet printer.

When the viscosity of the ink ejected from the head 12 changes, the ejection speed and/or the ejection amount of the ink from the head 12 changes. Therefore, in order to record images with desired image quality in the recording process, it is necessary that the controller 100 adjusts ejection conditions (e.g., an ink ejection timing, an ink ejection amount, and etc.) based on the viscosity of the ink ejected from the head 12. It is noted that adjustment of the ink ejection amount can be done by changing voltage levels and driving wave shapes of the four types of driving signals to be applied to each individual electrode 54.

Therefore, in order to adjust the ejection condition appropriately, it is required that the viscosity of the ink ejected from the head 12 is extrapolated with high accuracy. According to the illustrative embodiment, the MFP 1 uses the pigmented ink. The pigmented ink is composed such that the pigment particles are dispersed within the solvent. Accordingly, the viscosity of the pigmented ink largely depends on the concentration of the pigment particles (hereinafter, referred to as particle concentration). Further, as will be described later, the particle concentration of the ink supplied from the ink cartridges C to the head 12 is not always constant but varies. Therefore, the particle concentration of the ink ejected from the head 12 is not always constant either but varies. According to the illustrative embodiment, in order to extrapolate the viscosity of the ink ejected from the head 12 with high accuracy, the controller 100 extrapolate the particle concentration of the ink ejected from the head 12. It is noted that extrapolation of the particle concentration must be performed for each of four colors in practice. In the following description, however, the extrapolation for only one color will be described for brevity.

Hereinafter, the extrapolation of the particle concentration of the ink will be described in detail. Initially, a reason why the particle concentration of the ink supplied from the ink cartridges C to the head 12 changes will be explained. As described above, the ink stored in the ink cartridges C is the pigmented ink. The pigmented ink has a characteristic that the pigment particles, of which specific gravity is relatively large, precipitate at a bottom part of the ink cartridge C when maintained in a stationary state for a long period of time. As a result, at a bottom portion of the ink cartridge C, the particle concentration of the ink locally increases. At the same time, at a portion adjacent to a surface of the ink, the pigment particles in the pigmented ink decreases and the particle concentration is lowered. Therefore, in the ink cartridge C, a concentration distribution occurs such that the particle concentration is the highest at the bottom portion of the ink cartridge C, the particle concentration is lower at a portion, within the ink cartridge C, closer to the surface of the ink (i.e., at an upper portion of the ink cartridge C).

As above, unless the ink is supplied to the head 12, the particle concentration of the ink at the bottom part of the ink cartridge C increases with a lapse of time since the precipitating amount of the pigment particles increases with the lapse of time. In contrast, when the ink is supplied to the head 12, the ink at the bottom part of the ink cartridge C and having the high pigment concentration is supplied to the head 12. Therefore, in this case, as the ink is being supplied to the head 12, the particle concentration of the ink at the bottom part of the ink cartridge C decreases. Thus, as above, the viscosity distribution of the ink inside the ink cartridge C changes depending on a ink supplying speed from the ink cartridge C to the head 12 after the ink cartridge C is attached to the cartridge attachment section 8. Since the particle concentration of the ink supplied to the ink cartridge C to the head 12 changes, the particle concentration of the ink ejected from the head 12 also changes.

If information regarding the ink supplying speed to the head 12 after the ink cartridge C is attached to the cartridge attachment section 8 is obtained, the particle concentration of the ink ejected from the head 12 can be extrapolated to a certain extent. Therefore, according to the illustrative embodiment, the flash memory 104 stores total supplying amount information 104*d* and a lapse time information 104*e*.

The total supplying amount information 104*d* is information indicating the total supplying amount of the ink supplied from the ink cartridge C to the head 12 after the ink cartridge C is attached to the cartridge attachment section 8. The controller 100 performs the recording process, discharging process and the like to calculate the ink supplying amount every time when the ink is supplied from the ink cartridge C to the head 12 and add the calculate amount to the supplying amount represented by the total supplying amount information 104*d*.

It is noted that the amount of the ink ejected from the nozzles 45 in the recording process and when the flushing is performed can be calculated based on the driving condition of the piezoelectric actuator 22 of the head 12. Further, the amount of the ink discharged from the nozzles 45 when the suction purge is performed can be calculated based on the driving conditions of the suction pump 72 (e.g., a rotation speed, a rotating time period and the like). Therefore, the supplying amount of the ink which is supplied to the head 12 can be calculated. Further, the lapse time information 104*e* Further, the lapse time information 104*e* is information indicating the lapse time since the cartridges C are attached to the cartridge attachment section 8. Therefore, by subtracting the supplying amount represented by the total supplying amount information 104*d* with the lapse time indicated by the lapse time information 104*e*, the supplying speed of the ink after the cartridges C are attached to the cartridge attachment section 8 can be obtained.

The controller 100 performs a first extrapolating process (the first extrapolating process being an example of a first extrapolating process) of extrapolating the particle concentration of the ink ejected from the head 12 based on the total supplying amount information 104*d* and the lapse time information 104*e*.

In the flash memory 104, a concentration calculation formula CL, which is used to calculate the particle concentration of the ink based on the total supplying amount of the ink and the lapse time since the cartridges C are attached to the cartridge attachment section 8, is stored. The controller 100 extrapolated the particle concentration of the ink by calculating the same with use of the concentration calculation formula CL based on the total supplying amount information 104*d* and the lapse time information 104*e*. The extrapolated particle concentration is stored in a non-volatile memory as updated particle concentration information 104*c*. The newly stored particle concentration information 104*c* is information representing the particle concentration when the particle concentration of the ink ejected from the head 12 is extrapolated previously. It is noted that at the time when the ink cartridges C are attached to the cartridge attachment section 8, an initial concentration, which is the particle concentration of the ink at a time when the ink cartridges C are created, is stored as the particle concentration information 104*c* in the flash memory 104.

As above, by performing the first extrapolating process, it is possible to extrapolate the particle concentration of the ink ejected from the head 12 with a certain accuracy. However, in practice, the particle concentration of the ink also varies due to causes other than the ink supplying speed after the cartridges C are attached to the cartridge attachment section 8. Therefore, the particle concentration extrapolated in the first extrapolating process cannot be regarded as the concentration with the high accuracy.

According to the illustrative embodiment, the controller 100 is configured to perform a second extrapolating process (the second extrapolating process being an example of a second extrapolating process). The second extrapolating process requires a longer processing time than the first extrapolating process. However, by performing the second extrapolating process, the particle concentration of the ink ejected from the head 12 can be extrapolated with the high accuracy. The second extrapolating process is a process of extrapolating the particle concentration of the ink ejected from the head 12 based on recording result information of concentration pattern group S recorded on the printing sheet P.

In the following description, initially, matters to be regarded as prerequisites and the concentration pattern group S will be described before the second extrapolating process is described in detail.

The inventor found that a change rate of the viscosity of the ink when the temperature of the ink in the head 12 is raised by a unit amount varies depending on the particle concentration of the ink ejected from the head 12. Therefore, as shown in FIG. 5A, a change rate of the ink ejection speed when the temperature of the ink is raised by the unit temperature differs depending on the particle concentration of the ink. Specifically, the higher the particle concentration of the ink is, the larger the change rate of the ejection speed is when the temperature of the ink is raised by the unit temperature. The inventor further found that the lower the temperature of the ink is, the larger the change rate of the ejection speed is when the temperature of the ink is raised by the unit temperature.

Paying attention to the above phenomena, according to the illustrative embodiment, the concentration pattern group S as shown in FIGS. 6D-6E used to extrapolate the particle concentration of the ink ejected from the head 12 is recorded on the printing sheet P. The concentration pattern group S includes a first pattern R1 and a second pattern R2. The first pattern R1 and the second pattern R2 are recorded at different timings.

Hereinafter, process of recording of the first pattern R1 and the second pattern R2 on the printing sheet P. As will be described later, although the temperatures of the ink in the head 12 when the recording processes are performed are different, the processes are the same. Therefore, in the following description, the first pattern R1 and the second pattern R2 are referred to as a pattern R without distinction, and the process of recording the pattern R will be described.

Firstly, the controller 100 moves the carriage 11 rightward in the scanning direction and causes the plurality of nozzles 45 to eject the ink so that a line L1 extending in parallel with the conveying direction is recorded as shown in FIGS. 6A-6C. Further, the controller 100 moves the carriage 11 leftward in the scanning direction and causes the plurality of nozzles 45 to eject the ink so that a line L2 which extends in a direction inclined with respect to the conveying direction and crosses the line L1 is recorded as shown in FIGS. 6A-6C. Then, the pattern R including the line L1 and the line L2 is recorded.

The controller 100 controls the carriage 11 and the plurality of nozzles 45 to record the lines L1 and L2 such that the line L2 intersects with the line L1 at the center M of the line L1 as shown in FIGS. 6A-6C when the viscosity of the ink is a reference viscosity and the ink ejection speed is a reference speed. In the following description, recorded positions of the lines L1 and L2 on the printing sheet P when the ink ejection speed is the reference speed will be referred to as reference record positions. Further, in the following description, one-dimensional coordinate, in which an origin coincides with the center M, an upstream side in the conveying direction will be referred to as a positive side and a downstream side in the conveying direction will be referred to as a negative side, will be employed.

When the ink viscosity is lower than the reference viscosity and the ink ejection speed is relatively fast, the line L1 is shifted leftward with respect to its reference position, while the line L2 is shifted rightward with respect to its reference position as shown in FIG. 6B. Therefore, an intersection point X of the lines L1 and L2 is shifted on the negative side on the one-dimensional coordinate (i.e., the downstream side in the conveying direction) with respect to the center M of the line L1.

When the ink viscosity is higher than the reference viscosity and the ink ejection speed is relatively slow, the line L1 is shifted rightward with respect to its reference position, while the line L2 is shifted leftward with respect to its reference position as shown in FIG. 6C. Therefore, an intersection point X of the lines L1 and L2 is shifted on the positive side on the one-dimensional coordinate (i.e., the upstream side in the conveying direction) with respect to the center M of the line L1. As above, depending on the ink ejection speed, the intersection point X of the lines L1 and L2 on the one-dimensional coordinate is varied.

As described above, the first pattern R1 and the second pattern R2 are recorded on the printing sheet P. As slightly mentioned above, when the first pattern R1 and the second pattern R2 are recorded, the temperatures of the ink in the head 12 are different from each other. That is, recording of the second pattern R2 is started after a temperature raising operation is done. The temperature raising operation is an operation to raising the temperature of the ink in the head 12 with heat generated by the driver IC 61. In the temperature raising operation, the temperature is raised until the temperature indicated by the temperature signal output by the thermistor 66 is raised up to temperature T2 (the temperature T2 being an example of a second temperature) which is higher than temperature T1 (the temperature T1 being an example of a first temperature) when the first pattern R1 is recorded by a target temperature difference.

According to the above control, the ink ejection speeds from the head 12 when the first pattern R1 and the second pattern R2 are recorded, respectively are different. As a result, the recorded results of the first pattern R1 and the second pattern R2 are different from each other. That is, in the first pattern R1 and the second pattern R2, the positions of the intersection points X are different. A difference between the positional coordinate of the intersection point X of the first pattern R1 and the positional coordinate of the intersection point X of the second pattern R2 (hereinafter, the difference of the positional coordinates will be referred to as an intersection distance) represents a difference between the ejections speeds when the first pattern R1 and the second pattern R2 are recorded, respectively.

As described above, the higher the particle concentration of the ink is, the larger the change rate of the ejection speed when the temperature of the ink raised by the unit temperature is. Therefore, as shown in FIGS. 6D and 6E, the higher that particle concentration of the ink is, the longer the intersection distance is. In other words, if the intersection distance is obtained, it is possible to extrapolate the particle concentration of the ink. Therefore, the controller 100 obtains recording result information representing the intersection distance by detecting the image on the printing sheet P on which the concentration pattern group S is recorded with the scanning section 5.

In the flash memory 104, data set 104*b* which is referred to when the particle concentration of the ink is extrapolated. The data set 104*b* includes, as shown in FIG. 5C, concentration associating data 104*b*1 (the concentration associating data 104*b*1 being an example of data) defining correspondence between the intersection distance and the particle concentration of the ink. The controller 100 regards the particle concentration, in the concentration associating data 104*b*1, corresponding to the intersection distance indicating the obtained recording result information as the extrapolated particle concentration of the ink ejected from the head 12.

As shown in FIG. 5A, the change rate of the ejection speed when the temperature of the ink is raised by the unit amount varies depending on the temperature from which the temperature of the ink is raised. That is, even if the difference between the temperature T1 when the first pattern R1 is recorded and the temperature T2 when the second pattern R2 is recorded has the same value, when the temperature T1 itself has a different value, the intersection distance has a different value. Therefore, the data set 104*b* has the concentration associating data 104*b*1 for each of a plurality of temperature ranges. The controller 100 refers to the concentration associating data 104*b*1 corresponding to the temperature range to which the temperature T1 when the first pattern R1 is recorded belongs from among a plurality of pieces of concentration associating data 104*b*1, and extrapolate the particle concentration of the ink.

Further, as shown in FIG. 5A, the higher the temperature of the ink is, the smaller the change rate of the ejection speed when the temperature of the ink is raised by the unit temperature. Therefore, even if the temperature difference between the temperature T1 when the first pattern R1 is recorded and the temperature T2 when the second pattern R2 is recorded has the same value, the higher the temperature T1 is, the smaller the intersection distance, which is a shifting amount of landing positions of the first pattern R1 and the second pattern R2, is. That is, the higher the temperature T1 is, the smaller a changing amount of the intersection distance when the particle concentration changes by a unit concentration is. Accordingly, there is a possibility that the particle concentration of the ink cannot be extrapolated with high accuracy.

Therefore, the higher the temperature T1 is, the larger the controller 100 makes the target temperature difference between the temperatures T1. According to the illustrative embodiment, the flash memory 104 stores the target temperature difference setting table 104*a* (see FIG. 5B) defining target temperature differences corresponding to the temperature ranges, which are a low temperature range, an intermediate temperature range and a high temperature range. It is noted that the target temperature differences corresponding to respective temperature ranges are smallest in the low temperature range, intermediate in the intermediate temperature range and the highest in the high temperature range.

Then, the controller 1000 extracts the target temperature difference corresponding to the temperature range to which the temperature T1 when the first pattern R1 is recorded belongs based on the target temperature setting table 104*a*, and the temperature which is higher than the temperature T1 by the target temperature difference as the temperature T2. By this setting, the changing amount of the intersection distance when the particle concentration of the ink changes by the unit concentration amount, the particle concentration of the ink can be extrapolated with high accuracy. It is note that the "target temperature difference" describe above is the temperature difference necessary for achieving a desired extrapolation accuracy regarding the particle concentration of the ink. Accordingly, the higher the extrapolating accuracy is, the larger the "target temperature difference" is, so that the changing amount of the intersection distance when the particle concentration changes by the unit concentration amount becomes large.

As described above, by performing the second extrapolating process, the particle concentration of the ink ejected from the head 12 can be extrapolated with high accuracy in comparison with a case where the first extrapolating process is performed. The particle concentration extrapolated by the second extrapolating process is stored in the flash memory 104 as new particle concentration information 104.

When the first extrapolating process is to be performed, if the second extrapolating process has already been performed, the extrapolation accuracy becomes higher with use of the particle concentration extrapolated in the second extrapolating process. Therefore, according to the illustrative embodiment, the concentration calculating formula CL, which is used when the first extrapolating process is performed, contains a compensation coefficient. When the first extrapolating process is performed, the controller 100 adjusts the compensation coefficient of the concentration calculation formula CL based on the particle concentration information 104*c* stored in the flash memory 104. Since the particle concentration information 104*c* stored in the flash memory 104 is information to which the extrapolating result in the second extrapolating process has been reflected, the accuracy of the particle concentration extrapolated in the first extrapolating process can also be improved.

Next, an example of the process of the MFP 1 will be described referring to FIGS. 7A and 7B.

In S1, the controller 100 determines whether a first period has elapsed since the second extrapolating process was previously executed. When it is determined that the first period has elapsed since the second extrapolating process was previously executed (S1: YES), the controller 100 receives the temperature signal from the thermistor 66 and determines whether the temperature represented by the received temperature signal is less than a threshold temperature (S2). When it is determined that the temperature is less than the threshold temperature (S2: YES), the controller determines that the second extrapolating process should be performed, and causes the piezoelectric actuator 22 of the head 12 to perform flushing (S3). Thus, the ink, of which viscosity is increased, retained in the nozzles 45 can be discharged.

Next, the controller 100 receives the temperature signal from the thermistor 66 and obtains the temperature indicated by the temperature signal as temperature T1 (S4). Next, the controller 100 records the first pattern R1 on the printing sheet P by moving the carriage 11 in the scanning direction and causing the plurality of nozzles 45 to eject the ink (S5). Thereafter, the controller extracts the target temperature difference corresponding to the temperature range belonging to the temperature T1 obtained in S4 from the target temperature setting table 104*a* and sets the temperature higher than temperature T1 by the target temperature difference as temperature T2 (S6).

Next, the controller 100 executes the temperature raising operation to raise the temperature of the ink in the head 12 (S7). In the temperature raising operation, the controller 100 executes a non-ejection driving operation to drive the piezoelectric actuator 22 such that the ink is not ejected from the nozzles 45. With this control, the driver IC 61 is supplied with energy from the power circuit 63 and generates heat. As the heat generated by the driver IC 61 transmitted to the head 12, the temperature of the ink in the head 12 is raised. The non-ejection driving operation is continued until the temperature indicated by the temperature signal received from the thermistor 66 reaches the temperature T2 set in S6.

Next, the controller 100 controls the conveying motor 87 to convey the printing sheet P by a particular distance in the conveying direction. Thereafter, the controller 100 records the second pattern R2 on the printing sheet P by moving the carriage 11 in the scanning direction with causing the plurality of nozzles 45 to eject the ink (S8). As above control, the concentration extrapolating patter group S including the first pattern R1 and the second pattern R2 is recorded on the printing sheet P.

Next, the controller 100 displays, on the displaying section 6, a screen prompting the user to scan the recording result of the concentration pattern group S with the scanning section 5 (S9). For example, the screen is for prompting the user to input the scanning instruction by operating the operation panel 7 after placing the printing sheet P, on which the concentration extrapolation pattern group S has been recorded, to the scanning section of the MFP 1. The controller 100 pauses until the user inputs the scanning instruction (S10: NO). When the user inputs the scanning instruction (S10: YES), the controller causes the scanning section 5 to scan the image of the printing sheet P on which the concentration pattern group S has been recorded, thereby obtaining the recording result information regarding the recording result of the concentration pattern group S (S11). Thereafter, the controller 100 extract the concentration associating data 104*b*1 corresponding to the temperature T1 obtained in S4 from the data set 104*b*. Then, the controller 100 performs the second extrapolating process of extrapolating the particle concentration of the ink ejected from the head 12 based on the extracted concentration associating data 104*b*1 and the obtained recording result information (S12). Thereafter, the controller 100 stores the extrapolated particle concentration in the flash memory 104 as new particle concentration information 104*c* (S13) and returns to S1.

When it is determined that the first period has not elapsed since previous execution of the second extrapolating process (S1: NO), or when it is determined that the temperature indicated by the temperature signal from the thermistor 66 is equal to or greater than the threshold temperature (S2: NO), the controller 100 determines whether the second period has elapsed since the previous extrapolation of the particle concentration of the ink (S14). That is, the controller 100 determines whether the second period has elapsed since later one of the previous execution of the first extrapolating process or the previous execution of the second extrapolating process. According to the illustrative embodiment, the second period is shorter than the first period.

When it is determined that the second period has elapsed since the previous execution of the extrapolating process (S14: YES), the controller 100 executes the first extrapolating process to extrapolate the particle concentration of the ink ejected from the head 12 based on the particle concentration information 104*c*, the total supplying amount information 104*d* and the lapse time information 104*e* stored in the flash memory 104 (S15). Thereafter, the controller 100 stores the extrapolated particle concentration in the flash memory 104 as new particle concentration information 104*c* (S16) and returns to S1.

When it is determined that the second period has not elapsed since the previous extrapolation of the particle concentration of the ink (S14: NO), the controller 100 determines whether a recording instruction has been received from the external device 200 (S17). When it is determined that the recording instruction has been received (S17: YES), the controller 100 extrapolates the viscosity of the ink ejected from the head 12 based on the particle concentration information 104*c* and the temperature indicated by the temperature signal from the thermistor 66 (S18). Then, based on the extrapolated viscosity of the ink, the controller 100 determines the ejection conditions such as the ink ejection timing, the ink ejection amount and the like (S19). Thereafter, based on the determined ejection conditions, the controller 100 performs the recording process of recording images on the printing sheet P (S20). Upon completion of the process of S20, the controller 100 returns to S1.

As described above, according to the illustrative embodiment, when the concentration pattern group S including the first pattern R1 and the second pattern R2 is recorded, the second pattern R2 is recorded with the temperature of the ink in the head being higher than the temperature of the ink when the first pattern R1 is recorded. Accordingly, the shifting amount (i.e., the intersection distance) of the landing positions of the ink when the first pattern R1 is recorded and the landing positions of the ink when the second pattern R2 is recorded varies in accordance with the particle concentration of the ink, thereby the recording result of the concentration pattern group S varying. As a result, based on the recording result of the concentration extrapolating patter group S, it becomes possible to extrapolate the particle concentration of the ink ejected from the head 12 with high accuracy. Accordingly, it may be possible to perform the ejection control of the ink ejected from the head 12 based on the particle concentration of the ink.

It is noted that recording of the first pattern R1 is performed when the temperature indicated by the temperature signal transmitted from the thermistor 66 is less than the threshold temperature. The lower the temperature T1 when the first pattern R1 is recorded is, the larger the change rate of the ejection speed of the ink when the temperature of the ink is raised by the unit amount is, thereby the intersection distance being longer. Therefore, by performing the recording of the first pattern R1 when the temperature indicated by the temperature signal transmitted from the thermistor 66 is less than the threshold temperature, the particle concentration of the ink ejected from the head 12 can be extrapolated based on the recording result of the concentration pattern group S with high accuracy.

There could be a case where, the ink in the head 12 is configured such that the amount of the solvent has been decreased due to drying at a point of time when the recording result of the concentration pattern group is started. Since the first pattern R1 and the second pattern R2 are recorded at different timings, there could be a case where the particle concentrations when the respective patterns R1 and R2 are recorded are different. According to the illustrative embodiment, however, the piezoelectric actuator 22 the piezoelectric actuator 22 being an example of a liquid discharging section) is controlled to perform flushing (the flushing being an example of a discharging operation) to make the ink be discharged from the head 12 before the concentration pattern group S is recorded. Therefore, the particle concentrations of the ink ejected from the head 12 when the first pattern R1 is recorded and when the second pattern R2 is recorded can be made substantially the same. As a result, it is possible to extrapolate the particle concentration of the ink ejected from the head 12 with high accuracy based on the recording result of the concentration pattern group S.

When the driver IC 61 is controlled to drive the piezoelectric actuator 22, the driver IC 61 generates heat as the driver IC 61 is applied with energy from the power circuit 63. In the temperature raising operation, by performing the non-ejection driving operation to cause the driver IC 61 to generate heat, the temperature of the ink in the head 12 is raised. Therefore, according to the above configuration, a heater dedicated to heat the ink in the head 12 is not necessary.

Second Embodiment

Hereinafter, a second embodiment according to aspects of the present disclosures will be described. An MFP 201 according to the second embodiment employs a line-type inkjet printer and is configured such that the recording section 2 in the MFP 1 according to the first embodiment is replaced with a recording section 202 shown in FIG. 8. According to the first embodiment, the head 12 is moved relative to the printing sheet P by moving the head 12. In contrast, according to the second embodiment, the printing sheet P is moved so that a head 211 of the recording section 2 moves relative to the printing sheet P.

As shown in FIG. 8, the recording section 202 includes a head 211, a head holding member 212, a platen 213, a conveying roller pair 214 and a conveying roller pair 215 (the conveying roller pairs 214 and 215 being examples of a moving mechanism).

The head 211 is configured to ejects ink (i.e., ink droplets) from a plurality of nozzles 245 formed on a nozzle surface which is a lower surface of the head 211. The plurality of nozzles 245 are arranged, in the scanning direction, over an entire length of the printing sheet P to form nozzle rows 229 (see FIG. 8). According to the second embodiment, the head 211 is formed with four nozzle rows 229 which are aligned in the conveying direction. From respective ones of the plurality of (i.e., four) nozzle rows 245, black, yellow, cyan and magenta ink droplets are ejected in the order of an upstream side row to the downstream side row in the conveying direction.

The head holding member 212 is a plate-like member extending in the scanning direction, and holds the head 211. Similar to the head 11 of the first embodiment, the head 211 is provided with the driver IC 61 and the thermistor 66.

The conveying roller pairs 214 and 215 are respectively arranged on an upstream side and downstream side, in the conveying direction, with respect to the head 211. The conveying roller pairs 214 and 215 respectively have substantially the same configurations as the conveying roller pairs 14 and 15 of the first embodiment. A platen 214 is arranged below the head 211 and faces the nozzle surface of the head 211. The platen 213 is substantially the same as the platen 13 of the first embodiment.

Next, a concentration pattern group Z used to extrapolate the particle concentration of the ink ejected from the head 211 according to the second embodiment will be described. The controller 100 records the concentration pattern group Z including a first patter U1 and a second pattern U2 by conveying the printing sheet P with the conveying roller pairs 214 and 215 and by causing the plurality of nozzles 245 to eject the ink droplets as shown in FIGS. 9A and 9B. the first pattern U1 and the second pattern U2 are lines parallel to the scanning direction. Further, recording of the second pattern U2 is started after the temperature raising operation to raise the temperature of the in the head 211 has been performed, as in the first embodiment.

According to the above configuration, a separation distance V, which is a distance, in the conveying direction, between the first pattern U1 and the second pattern U2, varies in accordance with a difference between the ejection speeds of the ink at the times when the first pattern U1 is recorded and when the second pattern U2 is recorded. It is noted that, the higher the particle concentration of the ink is, the greater the difference between the ejection speeds of the ink when the first pattern U1 is recorded and when the second pattern U2 is recorded is, thereby the separation distance V being greater. Therefore, by obtaining the separation distance V, the particle concentration of the ink can be extrapolated.

In the second embodiment, the controller 100 obtains the recording result information which shows the separation distance V by detecting the image of the printing sheet P on which the concentration pattern group Z is recorded with the scanning section 5. Further, each piece of the concentration associating data 104*b*1 of the data set 104 stored in the flash memory 104 defines a relationship between the separation distance V and the particle concentration of the ink. Thus, the controller 100 extrapolates the particle concentration of the ink corresponding to the separation distance V indicated by the obtained recording result information in the concentration associating data 104*b*1 as the particle concentration of the ink ejected from the head 212.

An operation of the MFP 201 is performed in accordance with the flowchart shown in FIGS. 7A and 7B as in the first embodiment in which the MFP 1 operates. It is noted, however, that recording of the first pattern U1 in S5 and recording of the second pattern U2 in S8 are performed by causing the nozzles 245 of the head 211 to eject ink droplets with making the conveying roller pairs 214 and 215 convey the printing sheet P. It is noted that conveyance of the printing sheet P by the conveying roller pairs 214 and 215 between the process of S5 to record the first pattern U1 and the process of S8 to record the second pattern U2 may be continuously performed, or interrupted. For example, when a relatively long period is required to perform the temperature raising operation, conveyance of the printing sheet P may be interrupted.

As described above, also in the second embodiment, when the concentration pattern group Z including the first and second patterns U1 and U2 is recorded, the second pattern U2 is recorded with the temperature of the ink in the head 211 is raised to be higher than that when the first pattern U1 is recorded. With this configuration, a shifting amount (i.e., the separation distance V) between the landing positions of the ink when the first pattern U1 is recorded and when the second pattern U2 is recorded varies depending on the particle concentration of the ink, thereby the recording result of the concentration pattern group Z varies. As a result, it becomes possible to extrapolate the particle concentration of the ink ejected from the head 211 with high accuracy based on the recording result of the concentration pattern group Z. Further, it becomes possible to perform the ejection control of the ink ejected from the head 211 based on the particle concentration of the ink.

Third Embodiment

Hereinafter, a third embodiment according to aspects of the present disclosures will be described. In the first embodiment, recording of the second pattern R2 is started after the temperature raising operation has been performed. In the third embodiment, recording of the second pattern R2 is performed after a temperature lowering operation to lower the temperature of the ink in the head 12 with a cooling fan 120 has been performed. In the temperature lowering operation, the temperature, which indicated by the temperature signal transmitted from the thermistor 66, of the ink in the head 12 is lowered, with the cooling fan 120, to temperature T3 (T3 being an example of a second temperature), which is lower than the temperature T1 when the first pattern R1 is recorded, by a target temperature difference.

According to the third embodiment, different from the first embodiment, the temperature of the ink in the head 12 is lower when the second pattern R2 is recorded than when the first pattern R1 is recorded. Therefore, even if the temperature T1 of the ink when the first pattern R1 is recorded is the same as that in the first embodiment and the difference of the temperatures of the ink in the head 12 when the first pattern R1 is recorded and when the second pattern R2 is recorded is the same in the first embodiment and in the third embodiment, recording result of the concentration pattern group S recorded on the printing sheet P in the first embodiment, and recording result of the concentration pattern group S in the third embodiment are different from each other. Therefore, in the third embodiment, the flash memory 104 stores the target temperature difference setting table

104*a* and the data set 104*b*, content of the data according to the third embodiment is different from that according to the first embodiment.

Hereinafter, the operation of the MFP 1 according to the third embodiment will be described, referring to FIGS. 10A and 10B. It is noted that in FIGS. 10A and 10B, each of step numbers is indicated using an upper case "A" followed by an integer (e.g., "A1").

Firstly, the controller 100 executes A1-A5 which are the same as S1-S5 in the first embodiment (see FIG. 7A). Thereafter, the controller 100 extracts a target temperature difference corresponding to a temperature range to which the temperature T! obtained in A4 belongs from the target temperature setting table 104*a*, and set the temperature lower than the temperature T1 by the target temperature difference as temperature T3 (A6). Next, the controller 100 performs the temperature lowering operation to lower the temperature of the ink in the head 12 (A7). In the temperature lowering operation, the controller 100 keeps driving the cooling fan 120 until the temperature indicated by the temperature signal received from the thermistor 66 reaches the temperature T3 which is set in A6. After execution of the process of A7, the controller executes A8-A13 which are the same as S8-S13 of FIG. 7A according to the first embodiment, and returns to A1. Further, the controller 100 also executes A14-A20 which are the same as S14-S20 shown in FIG. 7B.

As above, according to the third embodiment, when the concentration pattern group S including the first and second patterns R1 and R2 is recorded, the second pattern R2 is recorded after the temperature of the ink in the head 12 is lowered to be lower than the temperature of the ink in the head 12 when the first pattern R1 is recorded. Thus, the shift amount between the ink landing positions when the first pattern R1 is recorded and when the second pattern R2 varies depending on the particle concentration of the ink, and the recording result of the concentration pattern group S varies. As a result, it is possible to extrapolate the particle concentration of the ink ejected from the head 12 with high accuracy based on the concentration pattern group S, and it becomes possible to perform the ink ejection control of the ink of the head 12 in accordance with the particle concentration of the ink.

Fourth Embodiment

Next, a fourth embodiment according to aspects of the present disclosures will be performed. In the first embodiment, the recording result information is obtained by making the scanning section 5 scan the image of the printing sheet P on which the concentration pattern group S has been recorded. In the fourth embodiment, the controller 100 obtains selection information (the selection information being an example of input information) which is input by the user who sees the printing sheet P on which a pattern group W is recorded as the recording result information. Further, according to the fourth embodiment, the controller 100 does not extrapolate the particle concentration of the ink ejected from the head 12, but determines the ejection condition of the ink of the head based on the recording result information as obtained.

In the fourth embodiment, as shown in FIG. 11, the flash memory 104 stores data set 104*f* instead of the data set 104*b* according to the first embodiment. The data set 104*f* includes ejection condition associating data 104*f*1 for each of temperature ranges regarding the temperature indicated by the temperature signal received from the thermistor 66. That is, the temperature indicated by the temperature signal from the thermistor 66 belongs to one of the plurality of temperature ranges. The ejection condition association data 104*f*1 is data associating the selection information (i.e., recording result information) with the ejection condition of the head 12. Further, according to the fourth embodiment, the flash memory 104 does not store the particle concentration information 104*c*, the total supplying amount information 104*d* or the lapse time information 104*e*.

Hereinafter, an operation of the MFP 1 according to the fourth embodiment will be described referring to FIG. 13. It is noted that in FIG. 13, each of step numbers is indicated using an upper case "B" followed by an integer (e.g., "B1").

The controller 100 firstly determines whether a setting instruction of the ejection condition is input by the user through the operation panel 7 (B1). When it is determined that the setting instruction is input (B1: YES), the controller executes B2-B3 which are the same as S3-S4 of the first embodiment. Thereafter, the controller 100 records a plurality of first patterns R1 (see FIG. 12) which are aligned in the scanning direction with a certain interval provided between each adjacent patterns R1 (B4). Specifically, the controller 100 causes the carriage 11 to move rightward in the scanning direction while cases the nozzles 45 to eject the ink, thereby recording a line L1 constituting each first pattern R1. Thereafter, the controller 100 causes the carriage 11 to move leftward in the scanning direction while cases the nozzles 45 to eject the ink, thereby recording a line L2 constituting each first pattern R1. At this stage, among the first patterns R1, the ink ejection timings to record the lines L2 with respect the ink ejection timings to record the line L1 are varied. Further, in areas, on the printing sheet P, adjacent to respective patterns R1 on the downstream side in the conveying direction, symbols N for identifying respective first patterns R1 (e.g., "A", "B", "C", "D" and "E" in FIG. 12) are recorded.

Thereafter, the controller 100 executes B5-B6 which are the same as S6-S7 of the first embodiment. Then, the controller 100 records a plurality of second patterns R2 which are aligned in the scanning direction with a certain interval between each adjacent second patterns R2 as shown in FIG. 13 (B7). The process of B7 is substantially the same as the process of B4. It is noted, however, in B7, in areas, on the printing sheet P, adjacent to respective patterns R2 on the downstream side in the conveying direction, symbols K for identifying respective first patterns R1 (e.g., "F", "G", "H", "I" and "J" in FIG. 12) are recorded. As above, a pattern group W including the plurality of first patterns R1 and the plurality of second patterns R2 is recorded on the printing sheet P.

Next, the controller 100 displays, on the displaying section 6, a screen prompting the user to input selection information representing selection of one of the first patterns R1 of which the intersection point X is the closest to the center M of the line L1 and selection of one of the second patterns R2 of which the intersection point X is the closest to the center M of the line L1 (B8).

It is noted that the controller 100 identifies the ejection timings when the lines L1 and lines L2 of the plurality of first patterns R1 and the plurality of second patterns R2, respectively. Therefore, by making the user select the first pattern R1 in which the intersecting point X is the closest to the center M of the line L1, based on the ejection timings when the lines L1 and L2 of the selected first pattern R1 are recorded, the ink ejection speed when the selected first pattern R1 is recorded can be obtained. Similarly, by making the user select the second pattern R2 in which the intersecting point X is the closest to the center M of the line L1, based on the ejection timings when the lines L1 and L2 of the selected second pattern R2 are recorded, the ink ejection speed when the selected second pattern R2 is recorded can be obtained. As a result, based on the input selection information, a difference between the ink ejection speeds when the first pattern R1 is recorded and when the second pattern R2 is recorded. That is, the selection information is information regarding a difference of the ejection speeds when the first pattern R1 is recorded and when the second pattern R2 is recorded.

The controller 100 pauses (B9: NO) until the selection information is input. When the selection information is input (B9: YES), the controller 100 extracts the ejection condition association data **104*f*1 corresponding to the temperature T1 obtained in A4 from the data set 104*f*, and determines the ejection condition based on the extracted ejection condition associating data 104*f*1 and the input selection information (B10). After execution of B19, the controller 100** returns to B.

When it is determined that the setting instruction of the ejection condition is not input by the user (B1: NO), the controller 100 determines whether the recording instruction is received from the external device 100 (B11). When it is determined that the recording instruction is received (B11: YES), the controller 100 performs the recording process of recording the image on the printing sheet P based on the ejection condition determined in B10 (B12). After execution of B12, the controller 100 returns to B1.

In the fourth embodiment, the plurality of second patterns R2 are recorded with the temperature of the ink in the head 12 is raised to be higher than the temperature when the plurality of first patterns R1 are recorded. Accordingly, the shift amount between the ink landing positions when the first patterns R1 are recorded and when the second patterns R2 are recorded varies depending on the particle concentration, and the recording result of the pattern group W varies. Then, based on the selection information input by the user who see the recording result of the pattern group W, an appropriate ejection condition corresponding to the particle concentration can be set, and the ink ejection control of the head 12 can be performed appropriately.

It is noted that aspects of the present disclosures need not be limited to configurations of the above-described embodiments, but various modification may be made without departing from aspects of the present disclosures. For example, among the first through fourth embodiments described above, portions of configurations thereof may be appropriately replaced. For example, in the MFP according to the second embodiment, recordation of the second pattern U2 may be performed after executing the temperature lowering operation to lower the temperature of the ink in the head with the cooling head 120 as is done in the third embodiment.

In the above-described embodiments, when the concentration pattern group is recorded, the second patterns are recorded after the first patterns have been recorded. However, aspects of the present disclosures need not be limited to such a configuration but can be modified. For example, the first patterns may be recorded after the second patterns are recorded and the temperature indicated by the temperature signal from the thermistor has reached the temperature T1.

In the above-described embodiments, the concentration pattern group includes only two types of patterns (i.e., the first pattern and the second pattern). However, aspects of the present disclosures need not be limited to such a configuration but can be modified. That is, the concentration pattern group may include three or more types of patterns respectively recorded at different timings. In such a case, the temperature raising operation and/or the temperature lowering operation may be appropriately executed so that the temperatures of the ink in the head 12 when the three or more types of patterns are recorded are different from each other. By employing the three or more types of patterns, there could be a case where the particle concentration of the ink can be extrapolated more accurately with respect to a case where the two types of patterns are recorded. Further, the concentration pattern group need not be limited to the above-described ones. Any concentration pattern group may be employed if the ink ejection speed difference between a case when the first patterns are recorded and when the second patterns are recorded can be obtained therefrom.

According to the above-described embodiments, the controller 100 causes the piezoelectric actuator 22 of the head 12 to perform flushing before the concentration pattern group is recorded. Instead of performing the flushing, the controller 100 may cause the purging device 70 to perform the suction purge before the concentration pattern group is recorded. In such a case, the purging device 70 is an example of the liquid discharging section. Alternatively, the flushing (or the purging) may not be performed before the concentration pattern group is recorded.

The above-described embodiments may be modified such that, when the extrapolated particle concentration is equal to or greater than the particular threshold concentration, the purging device 70 may be controlled to perform the suction purge such that the ink of which particle concentration is equal to or greater than the particular threshold concentration is discharged from the nozzles.

In the first, second and fourth embodiments, the ink in the head is raised with the heat generated by the driver IC 61. Aspects of the present disclosures need not be limited to such a configuration. For example, the head may be one configured to apply heat to ink enclosed in a pressure chamber by heating elements (the heating element being examples of a heat source of a driving element) so that bubbles are generated within the pressure chamber thereby the ink being ejected from the nozzles. In this case, by driving the heating elements to heat the ink so that the ink is not ejected from the nozzles, the ink in the head can be heated.

In the first, second and fourth embodiments, a temperature higher than the temperature T1, which is the temperature when the first patterns are recorded, by the target temperature difference is set as the temperature T2. This configuration may be modified such that a temperature higher than the temperature T1 by an amount which is equal to or greater than the target temperature difference may be set as the temperature T2.

Similarly, in the third embodiment, a temperature lower than the temperature T1, which is the temperature when the first patterns are recorded, by the target temperature difference is set as the temperature T3. This configuration may be modified such that a temperature lower than the temperature T1 by an amount which is equal to or greater than the target temperature difference may be set as the temperature T3.

In the third embodiment, the cooling fan is used as the cooling device to lower the temperature of the ink. It is noted that the cooling device need not be limited to the cooling fan but any other devices which can lower the temperature of the ink in the head can be employed. For example, the cooling device may be one having a circulating passage which is configured such that coolant (i.e., cooling liquid) stored in a coolant tank is flowed inside the carriage through a coolant channel and returned to the coolant tank. With use of such a device, by making the coolant circulate within the circulating passage including the coolant channel, heat exchange is performed between the coolant and the head, thereby the head being cooled and the ink in the head being also cooled.

Further, in the above-described embodiments, the head generates heat as energy is applied from the power circuit when the head is driven, and the ink is heated by the thus generated heat. However, aspects of the disclosures need not be limited to such a configuration such that the head has the heat source therein. For example, a heater dedicated to heat the ink in the head may be provided at a position adjacent to the head and the ink in the head may be heated with the heater until the temperature of the ink in the head reaches the temperature T2. In such a case, the heater is an example of a heat source and an operation of heating the ink with use of the heater is an example of an temperature raising operation.

In the above-described embodiments, information regarding the temperature of the ink in the head is obtained based on the signal output by the thermistor provided to the FPC. Aspects of the disclosures need not be limited to such a configuration. For example, the driver IC may be configured to output a temperature signal indicating the temperature of the driver IC itself, and the information regarding the temperature of the ink in the head may be obtained based on the temperature signal output by the driver IC. Alternatively, a temperature sensor may be provided to the head, and the information regarding the temperature of the ink in the head may be obtained based on an output result of the temperature sensor.

In the above-described embodiments, the printing sheet P is conveyed by the conveying roller pairs which are arranged on both sides, in the conveying direction, of the head. However, aspects of the present disclosures need not be limited to the configurations of the above-described embodiments but can be modified in various ways. For example, a conveying belt configured to run in the conveying direction may be arranged to face the plurality of nozzles of the head, and the printing sheet P may be placed on the conveying belt. In such a configuration, as the conveying belt runs in the conveying direction, the printing sheet P placed on the conveying belt is moved in the conveying direction. Optionally, the conveying belt may be provided with an attracting section configured to attract the printing sheet P so that the printing sheet P is securely caught when the conveying belt runs. For example, the attracting part may have a suction mechanism configured to suction the air. For another example, the attracting part may be configured to attract the printing sheet P with an electrostatic force.

In the above-described embodiments, the MFP's use the cut sheet, which has both a leading end and trailing end in the conveying direction, as the printing sheet. However, the MFP's or the printers need not be limited to be configured as above. That is, an MFP (or a printer) may be configured to employ a roll sheet which extends continuously in the conveying direction and rolled.

It is noted that the configurations describe above may be applied to a printer configured to form an image on a printing medium other than the printing sheet. For example, the above-described configurations may be applied to a printer which is configured to have a stage, which is movable in the conveying direction, having the printing medium placed thereon and print an image on the printing medium by alternately executing a moving operation to move the stage on which the printing medium is placed in the conveying direction and an ink ejecting operation. Examples of the printing medium for such a printer may include a T-shirt, a field advertisement sheet and the like.

In the above-described embodiments, the MFP's (or printers) are provided with the head configured to eject the pigmented ink which is composed with pigmented ink dispersed within the solvent is used. Aspects of the disclosures need not be limited to such a configuration. Aspects of the above-described embodiments may also be applied to a liquid ejecting apparatus provided with a head configured to eject, for example, liquid composed of metallic particles dispersed within the solvent, liquid composed of synthetic resin particles dispersed within the solvent or liquid composed of particles other than the pigment particle dispersed within the solvent.

What is claimed is:

1. A liquid ejecting apparatus, comprising:

a head configured to eject liquid supplied from a tank, the liquid containing particles dispersed in solvent;

a moving mechanism configured to move at least one of a recording medium and the head such that a relative movement of the head and the recording medium is performed;

a temperature signal device configured to output a temperature signal corresponding to a temperature of the liquid in the head;

a heat source; and a controller, wherein the controller is configured to cause the moving mechanism to perform the relative movement between the head and the recording medium and cause the head to eject the liquid towards the recording medium to record a concentration pattern group including a first pattern and a second pattern, the controller being configured to extrapolate a particle concentration of the liquid ejected from the head based on the concentration pattern group as recorded on the recording medium, wherein, when the concentration pattern group is recorded:

the controller controls the head and the moving mechanism such that the first pattern and the second pattern are recorded at different timings; and recording of the second pattern is started after execution of a temperature raising operation, the temperature raising operation being an operation to cause the heat source to generate heat and raise the temperature of the liquid in the head by applying the heat generated by the heat source until a temperature indicated by the temperature signal output by the temperature signal device has reached temperature T2 which is higher, by a target temperature difference, than temperature T1 which is a temperature of the liquid when the first pattern is recorded.

2. The liquid ejecting apparatus according to claim 1, further comprising a storage configured to store data indicating a relationship between a recordation result of the concentration pattern group and the particle concentration of the liquid ejected from the head, wherein the controller is configured to:

obtain result information regarding the recordation result of the concentration pattern group recorded on the recording medium; and extrapolate the particle concentration of the liquid ejected from the head based on the obtained result information and the data stored in the storage.

3. The liquid ejecting apparatus according to claim 2, further comprising an image detecting section configured to detect an image recorded on the recording medium, wherein the controller is configured to obtain the result information by detecting, with use of the image detecting section, the image of the recording medium on which the concentration pattern group is recorded.

4. The liquid ejecting apparatus according to claim 2, wherein, when the controller extrapolates the particle concentration of the liquid ejected from the head, the controller is configured to store the extrapolated particle concentration in the storage, wherein the controller is configured to selectively execute, as extrapolation of the particle concentration of the liquid ejected from the head, one of:

a first extrapolation based on a previous particle concentration stored in the storage and information regarding a supplying speed of the liquid from the tank to the head, the previous particle concentration being the particle concentration previously extrapolated; and a second extrapolation based on the obtained result information and the data stored in the storage.

5. The liquid ejecting apparatus according to claim 1, wherein the controller determines the target temperature difference such that the higher the first temperature T1 is, the larger the target temperature difference is.

6. The liquid ejecting apparatus according to claim 1, further comprising a liquid discharging section, wherein the controller is configured to cause the liquid discharging section to perform a liquid discharging operation for discharging the liquid from the head before the concentration pattern group is recorded.

7. The liquid ejecting apparatus according to claim 1, wherein the controller is configured to cause the moving mechanism and the head to record the first pattern on the recording medium when the temperature of the liquid indicated by the temperature signal output by the temperature signal device is less than a threshold temperature.

8. The liquid ejecting apparatus according to claim 1, further comprising a power source, wherein the heat source is provided to the head, the heat source being configured to receive energy from the power source to generate heat when the head is being driven, wherein the controller is configured to drive the head when executing the temperature raising operation to make the heat source generate the heat.

9. The liquid ejecting apparatus according to claim 8, wherein the head includes:

a driving element configured to apply ejecting energy to the liquid in the head; and a driving circuit configured to drive the driving element, the driving circuit serving as the heat source.

10. The liquid ejecting apparatus according to claim 1, wherein the moving mechanism comprises a carriage having the head mounted thereon and configured to move in a scanning direction.

11. A liquid ejecting apparatus, comprising:

a head configured to eject liquid supplied from a tank, the liquid containing particles dispersed in solvent;

a moving mechanism configured to move at least one of a recording medium and the head such that a relative movement of the head and the recording medium is performed;

a temperature signal device configured to output a temperature signal corresponding to a temperature of the liquid in the head;

a cooling device; and a controller, wherein the controller is configured to cause the moving mechanism to perform the relative movement between the head and the recording medium and cause the head to eject the liquid towards the recording medium to record a concentration pattern group including a first pattern and a second pattern, the controller being configured to extrapolate a particle concentration of the liquid ejected from the head based on the concentration pattern group as recorded on the recording medium, wherein, when the concentration pattern group is recorded:

the controller controls the head and the moving mechanism such that the first pattern and the second pattern are recorded at different timings; and recording of the second pattern is started after execution of a temperature lowering operation, the temperature lowering operation being an operation to cause the cooling device to lower the temperature of the liquid in the head until a temperature indicated by the temperature signal output by the temperature signal device has reached temperature T2 which is lower, by a target temperature difference, than temperature T1 which is a temperature of the liquid when the first pattern is recorded.

12. A liquid ejection controlling method for a liquid ejecting apparatus having a head configured to eject liquid supplied from a tank, the liquid containing particles dispersed in solvent, a moving mechanism configured to move at least one of a recording medium and the head such that a relative movement of the head and the recording medium is performed, the method comprising:

recording a pattern group including a first pattern and a second pattern by driving the moving mechanism to perform the relative movement between the head and the recording medium and by driving the head to eject the liquid towards the recording medium; and receiving user input of input information based on recording results of the first pattern and the second pattern, ejection of the liquid from the head being controlled based on the input information as received, wherein recording of the pattern group is performed such that:

the first pattern and the second pattern are recorded at different timings; and recording of the second pattern is performed when a temperature of the liquid in the head is temperature T2 which is different, by a target temperature difference or more, from temperature T1 which is a temperature of the liquid when the first pattern is recorded.

* * * * *